US006010842A

United States Patent [19]

Suga et al.

[11] Patent Number: 6,010,842

[45] **Date of Patent: *Jan. 4, 2000**

[54] SILVER HALIDE PHOTOGRAPHIC LIGHT-SENSITIVE MATERIAL

[75] Inventors: Yoichi Suga; Masato Taniguchi, both of Minami-Ashigara, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/921,359

[22] Filed: Aug. 29, 1997

[30] Foreign Application Priority Data

Aug. 30, 1996 [JP] Japan ..... 8-246911

[51] Int. Cl.[7] ..... G03C 1/12; G03C 1/33; G03C 1/34

[52] U.S. Cl. ..... 430/588; 430/577; 430/581; 430/583; 430/584; 430/600; 430/607; 430/613; 430/614; 430/624

[58] Field of Search ..... 430/583, 584, 430/588, 581, 577, 613, 607, 600, 614, 626

[56] References Cited

U.S. PATENT DOCUMENTS

| | | | |
|---|---|---|---|
| 3,893,863 | 7/1975 | Wilson et al. . | |
| 4,118,228 | 10/1978 | Corluy et al. . | |
| 4,330,606 | 5/1982 | Sobel et al. . | |
| 5,290,676 | 3/1994 | Nagaoka et al. | 430/583 |
| 5,308,748 | 5/1994 | Ikegawa et al. | 430/583 |
| 5,310,630 | 5/1994 | Inagaki | 430/434 |
| 5,563,025 | 10/1996 | Ishii et al. . | |

*Primary Examiner*—Thorl Chea
*Attorney, Agent, or Firm*—Birch, Stewart, Kolasch & Birch, LLP

[57] ABSTRACT

A silver halide photographic light-sensitive material has at least one light-sensitive silver halide emulsion layer on a support, wherein a light-sensitive silver halide emulsion in the emulsion layer contains a compound represented by formula (I) below and a compound represented by formula (II) below.

Formula (I)

In formula (I), each of $R_1$ to $R_3$ represents a hydrogen atom, an alkyl group, or an aryl group.

Formula (II)

In formula (II), R represents a specific alkyl group, each of $L_1$ and $L_2$ represents a methine group, $p_1$ represents 0 or 1, $Z_1$ represents atoms required to form a 5- or 6-membered nitrogen-containing heterocyclic ring, $M_1$ represents a charge-balancing counter ion, $m_1$ represents a number from 0 to 10 required to neutralize electric charge of a molecule, and Q represents a methine group or a polymethine group substituted by a heterocyclic group or an aromatic group.

18 Claims, No Drawings

SILVER HALIDE PHOTOGRAPHIC LIGHT-SENSITIVE MATERIAL

BACKGROUND OF THE INVENTION

The present invention relates to a silver halide photographic light-sensitive material and, more particularly, to a silver halide photographic light-sensitive material with a high sensitivity and a high storage stability.

Silver halide photographic light-sensitive materials, particularly light-sensitive materials for photographing are required to have a high sensitivity and are also desired not to change photographic properties in various use environments. Jpn. Pat. Appln. KOKAI Publication No. (hereafter referred to as JP-A-)7-239540 has disclosed a silver halide light-sensitive material which has a high sensitivity and a high resistance to damage by pressure and which increases a fog little after being stored for long time periods. The silver halide light-sensitive material disclosed in JP-A-7-239540 showed good results when left to stand at 35° C. for six months, i.e., under comparatively mild storage conditions. However, photographic light-sensitive materials are used in a variety of environments. For example, photographic light-sensitive materials are often placed in automobiles under the blazing sun or piled in wagons in front of photograph shops on sunny days. The temperature in an automobile under the blazing sun is said to be 80° C. or higher, and this is a very severe condition for silver halide light-sensitive materials. The effect of the above-mentioned invention is unsatisfactory under this condition, so it turns out that further improvements are necessary.

For the above reasons, a silver halide photographic light-sensitive material which changes photographic properties little even at high temperatures is demanded.

BRIEF SUMMARY OF THE INVENTION

It is an object of the present invention to provide a silver halide photographic light-sensitive material having a high sensitivity and a high storage stability.

As a result of extensive studies, the object of the present invention could be achieved by a silver halide photographic light-sensitive material having at least one light-sensitive silver halide emulsion layer on a support, wherein a light-sensitive silver halide emulsion in the emulsion layer contains a compound represented by formula (I) below and a compound represented by formula (II) below.

Formula (I)

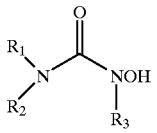

In formula (I), $R_1$, $R_2$, and $R_3$ can be the same or different and each represents a hydrogen atom, an alkyl group, or an aryl group.

Formula (II)

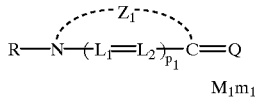

In formula (II), R is an alkyl group represented by the following formula.

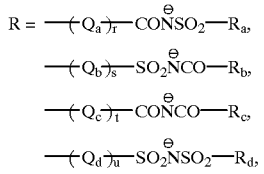

Each of $R_a$, $R_b$, $R_c$, and $R_d$ represents an alkyl group, a heterocyclic group, an alkoxy group, an aryloxy group, or an amino group, each of $Q_a$, $Q_b$, $Q_c$, and $Q_d$ represents a methylene group, and each of r, s, t, and u represents an integer from 1 to 10.

Each of $L_1$ and $L_2$ represents a methine group. $p_1$ represents 0 or 1. $Z_1$ represents at least one atom required to form a 5- or 6-membered nitrogen-containing heterocyclic ring. $M_1$ represents a charge-balancing counterion, and $m_1$ represents a number from 0 to 10 required to neutralize electric charge of a molecule. Q represents a methine group or a polymethine group substituted by a heterocyclic group or an aromatic group.

Preferably, the above silver halide photographic light-sensitive material contains at least one compound represented by formula (III) below.

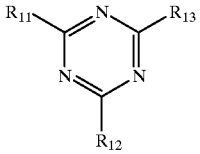

In formula (III), $R_{11}$, $R_{12}$, and $R_{13}$ can be the same or different and each represents a hydroxy group, an amino group, an alkylamino group, an arylamino group, an alkoxy group, an aryloxy group, an alkyl group, an aryl group, an alkylthio group, or a group represented by formula (IV) below. Note that at least one of $R_{11}$, $R_{12}$, and $R_{13}$ is a group represented by formula (IV) below. Formula (IV)

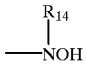

In formula (IV), $R_{14}$ represents a hydrogen atom, an alkyl group, an alkenyl group, or an aryl group.

More preferably, the object of the present invention is achieved by a silver halide photographic light-sensitive material characterized in that silver halide grains in the above light-sensitive silver halide emulsion are reduction-sensitized.

DETAILED DESCRIPTION OF THE INVENTION

The present invention will be described in detail below.

Details of formula (I) used in the present invention will be described.

Formula (I)

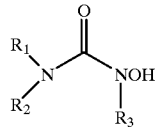

In formula (I), $R_1$, $R_2$, and $R_3$ can be the same or different and each represents a hydrogen atom, an alkyl group, or an aryl group.

$R_1$, $R_2$, and $R_3$ in a compound represented by formula (I) in the present invention will be described in detail below.

$R_1$, $R_2$, and $R_3$ can be the same or different and each represents a hydrogen atom, an alkyl group, or an aryl group. If each of $R_1$, $R_2$, and $R_3$ represents an alkyl group or an aryl group, these groups can have substituent groups. Examples of the substituent groups are a halogen atom, aryl group, a heterocyclic group, a cyano group, a nitro group, a hydroxyl group, a carboxyl group, a sulfo group, an alkoxy group, an aryloxy group, an acylamino group, an amino group, an alkylamino group, an anilino group, a ureido group, a thioureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imide group, a heterocyclic thio group, a sulfinyl group, a phosphonyl group, an aryloxycarbonyl group, and an acyl group. Furthermore, if each of $R_1$, $R_2$, and $R_3$ is an aryl group, examples of substituent groups include an alkyl group, an alkenyl group, and an alkinyl group in addition to the above substituent groups starting from the halogen atom to the acyl group.

If each of $R_1$, $R_2$, and $R_3$ is an alkyl group, this alkyl group is, a straight-chain, branched-chain, or cyclic alkyl group having 1 to 16 carbon atoms, preferably 1 to 10 carbon atoms. Examples are methyl, ethyl, propyl, isopropyl, t-butyl, 2-hydroxyethyl, 3-hydroxypropyl, benzyl, 2-methanesulfonamidoethyl, 2-methoxyethyl, cyclopentyl, 2-acetamidoethyl, 2-carboxyethyl, 2,3-dihydroxypropyl, n-hexyl, n-decyl, and n-hexadecyl.

If each of $R_1$, $R_2$, and $R_3$ is an aryl group, this aryl group is an aryl group having 6 to 24 carbon atoms, preferably 6 to 10 carbon atoms. Examples are phenyl, naphthyl, 2-methylphenyl, 3-ethylphenyl, 4-methoxyphenyl, 3-dimethylaminophenyl, 4-trifluorophenyl, and 2,4,5-trichlorophenyl.

Preferable combinations of $R_1$, $R_2$, and $R_3$ in formula (I) will be described below.

One preferable combination is that $R_1$ is a hydrogen atom, an alkyl group whose total carbon atoms is 1 to 10, or an aryl group whose total carbon atoms is 6 to 10, $R_2$ is a hydrogen atom, and $R_3$ is a hydrogen atom, an alkyl group whose total carbon atoms is 1 to 10, or an aryl group whose total carbon atoms is 6 to 10.

A more preferable combination is a compound in which $R_2$ is a hydrogen atom and the total carbon atoms of $R_1$ and $R_3$ is 7 or less.

A further preferable combination is that both $R_1$ and $R_2$ are hydrogen atoms and $R_3$ is a hydrogen atom or an alkyl group whose total carbon atoms is 1 to 4. A practical example (S-4) or (S-12) (to be presented later) is most preferable among others.

Note that these alkyl and aryl groups mentioned above in preferable combination include groups substituted by substituent groups. The total carbon atoms of an alkyl group or an aryl group substituted by a substituent group includes the number of carbon atoms of that alkyl or aryl group and the number of carbon atoms of the substituent group.

Practical examples of representative compounds represented by formula (I) used in the present invention are presented below. However, the present invention is not limited to these examples.

(S-1)

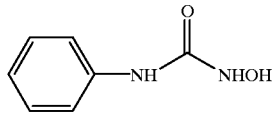

(S-2)

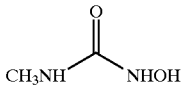

(S-3)

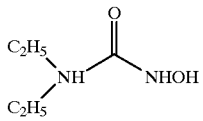

(S-4)

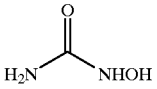

(S-5)

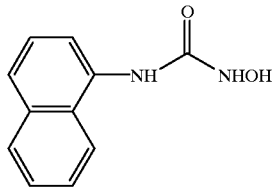

(S-6)

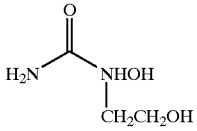

(S-7)

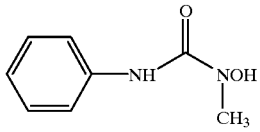

(S-8)

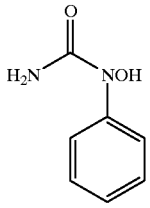

-continued (S-9)

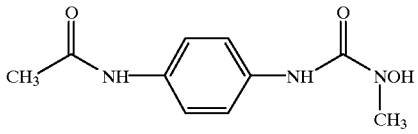

(S-10)

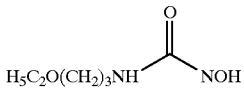

(S-11)

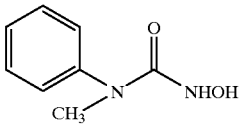

(S-12)

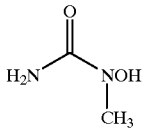

(S-13)

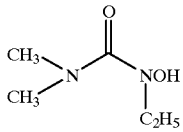

(S-14)

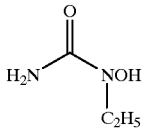

(S-15)

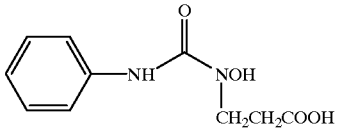

(S-16)

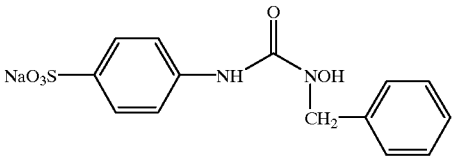

(S-17)

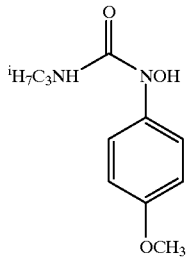

(S-18)

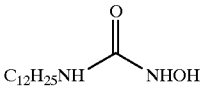

-continued (S-19)

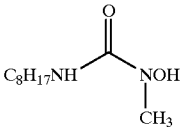

Compounds represented by formula (I) of the present invention, e.g., the practical example (S-4) is commercially available from Tokyo Kasei Kogyo K.K. and is readily obtainable. Also, compounds represented by formula (I) can be easily synthesized following scheme 1 below.

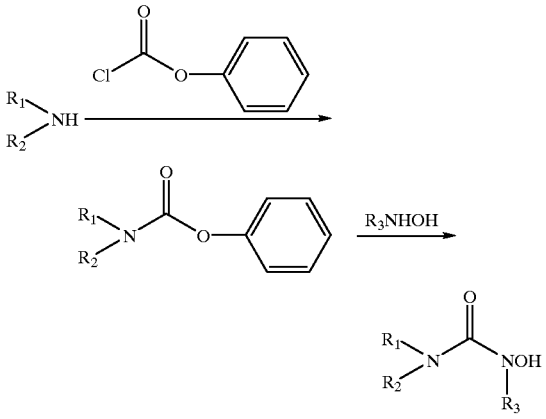

In the above formula, each of $R_1$, $R_2$, and $R_3$ has the same meaning as described above.

The addition amount of a compound of formula (I) is preferably $0.5\times10^{-6}$ mol to $1.0\times10^{-2}$ mol, and more preferably $1.0\times10^{-5}$ mol to $5.0\times10^{-3}$ mol per mol of the silver halide in the light-sensitive silver halide emulsion.

A compound of formula (I) can be added at any time during a formation process of silver halide grains, a chemical sensitization process, and a coating process of silver halide grains. However, the compound is preferably added before the start of chemical sensitization in the chemical sensitization process.

It is also possible to add a compound to a protective layer or an interlayer and diffuse the compound toward a light-sensitive emulsion layer after coating.

Details of formula (II) will now be described.

Formula (II)

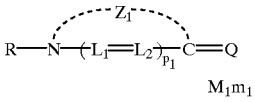

In formula (II), R is an alkyl group represented by the following formula.

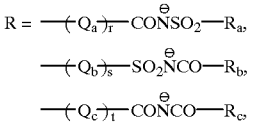

-continued

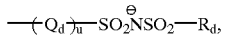

Each of $R_a$, $R_b$, $R_c$, and $R_d$ represents an alkyl group, an aryl group, a heterocyclic group, an alkoxy group, an aryloxy group, or an amino group, each of $Q_a$, $Q_b$, $Q_c$, and $Q_d$ represents a methylene group, and each of r, s, t, and u represents an integer from 1 to 10.

Each of $L_1$ and $L_2$ represents a methine group. $p^1$ represents 0 or 1. $Z_1$ represents at least one atom required to form a 5- or 6-membered nitrogen-containing heterocyclic ring. $M_1$ represents a charge-balancing counter ion, and $m_1$ represents any number from 0 to 10 required to neutralize electric charge of a molecule. Q represents a methine group or a polymethine group substituted by a heterocyclic group or an aromatic group.

A compound represented by formula (II) is more preferably a compound selected from formulas (II-1), (II-2), and (II-3).

Formula (II-1)

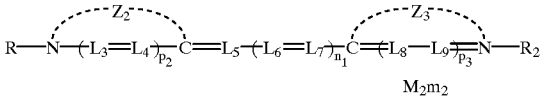

In formula (II-1), each of $L_3$, $L_4$, $L_5$, $L_6$, $L_7$, $L_8$, and $L_9$ represents a methine group. Each of $p^2$ and $p_3$ represents 0 or 1. $n_1$ represents 0, 1, 2, or 3. Each of $Z_2$ and $Z_3$ represents at least one atom required to form a 5- or 6-membered nitrogen-containing heterocyclic ring. $M_2$ represents a charge-balancing counter ion, and $m_2$ represents a number from 0 to 4 required to neutralize electric charge of a molecule. Each of $R_1$ and $R_2$ represents an alkyl group. Note that at least one of $R_1$ and $R_2$ is a group represented by R in formula (II).

Formula (II-2)

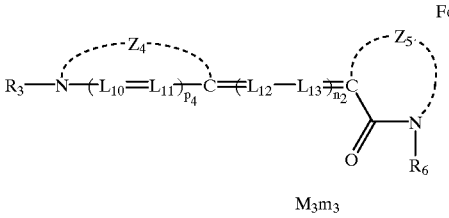

In formula (II-2), each of $L_{10}$, $L_{11}$, $L_{12}$, and $L_{13}$ represents a methine group. $p_4$ represents 0 or 1. $n_2$ represents 0, 1, 2, or 3. Each of $Z_4$ and $Z_5$ represents at least one atom required to form a 5- or 6-membered nitrogen-containing heterocyclic ring. $M_3$ represents a charge-balancing counter ion, and $m_3$ represents a number from 0 to 4 required to neutralize electric charge of a molecule. $R_3$ has the same meaning as R in formula (II). $R_4$ represents an alkyl group, an aryl group, or a heterocyclic group.

Formula (II-3)

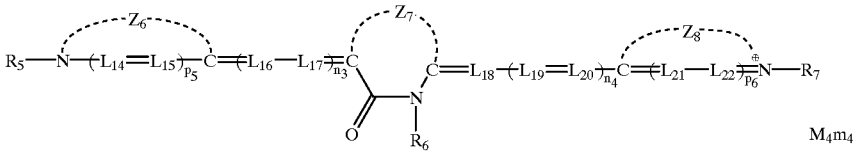

In formula (II-3), each of $L_{14}$, $L_{15}$, $L_{16}$, $L_{17}$, $L_{18}$, $L_{19}$, $L_{20}$, $L_{21}$, and $L_{22}$ represents a methine group. Each of $p_5$ and $p_6$ represents 0 or 1. Each of $n_3$ and $n_4$ represents 0, 1, 2, or 3. Each of $Z_6$, $Z_7$, and $Z_8$ represents at least one atom required to form a 5- or 6-membered nitrogen-containing heterocyclic ring. $M_4$ represents a charge-balancing counter ion, and $m_4$ represents a number from 0 to 4 required to neutralize electric charge of a molecule. Each of $R_5$ and $R_7$ represents an alkyl group. Note that at least one of $R_5$ and $R_7$ is a group represented by R in formula (I). $R_6$ represents an alkyl group, an aryl group, or a heterocyclic group.

A compound represented by formula (II) can form any methine dye dependant on Q. Examples of preferable methine dyes are a cyanine dye, a merocyanine dye, a rhodacyanine dye, a trinuclear merocyanine dye, an allopolar dye, a hemicyanine dye, and a styryl dye. Details of these dyes are described in, e.g., F. M. Harmer, "Heterocyclic Compounds-Cyanine Dyes and Related Compounds", John Wiley & Sons, New York, London, 1964, D. M. Sturmer, "Heterocyclic Compounds-Special topics in heterocyclic chemistry", chapter 18, paragraph 14, items 482 to 515.

Formulas of a cyanine dye, a merocyanine dye, and a rhodacyanine dye are preferably those indicated by (XI), (XII), and (XIII) on pages 21 and 22 in U.S. Pat. No. 5,340,694.

Formula (II) can also be expressed by the following resonance formula in case a cyanine dye is formed dependant on Q.

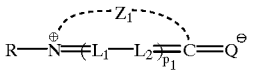

In formulas (II), (II-1), (II-2), and (II-3), examples of a 5- or 6-membered nitrogen-containing heterocyclic ring formed with $Z_1$, $Z_2$, $Z_3$, $Z_4$, $Z_6$, or $Z_8$ are a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzoimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, and a pyrimidine nucleus.

Preferable examples are a benzoxazole nucleus, a benzothiazole nucleus, a benzoimidazole nucleus, and a quinoline nucleus, and more preferable examples are a benzoxazole nucleus and a benzothiazole nucleus. In formula (II-1), it is particularly preferable that either one of two heterocyclic rings formed with $Z_2$ and $Z_3$, respectively be a benzothiazole nucleus and the other be a benzothiazole nucleus or a benzoxazole nucleus.

Assuming a substituent group on $Z_1$, $Z_2$, $Z_3$, $Z_4$, $Z_6$, and $Z_8$ is V, this substituent group represented by V is not particularly limited. Examples are a halogen atom (e.g., chlorine, bromine, iodine, and fluorine), a mercapto group, a cyano group, a carboxyl group, a phosphate group, a sulfo group, a hydroxy group, a carbamoyl group having 1 to 10 total carbon atoms, preferably 2 to 8 total carbon atoms, and more preferably 2 to 5 total carbon atoms (e.g., methylcarbamoyl, ethylcarbamoyl, and morpholinocarbamoyl), a sulfamoyl group having 0 to 10 total carbon atoms, preferably 2 to 8 total carbon atoms, and more preferably 2 to 5 total carbon atoms (e.g., methylsulfamoyl, ethylsulfamoyl, and piperidinosulfamoyl), a nitro group, an alkoxy group having 1 to 20 total carbon atoms, preferably 1 to 10 total carbon atoms, and more preferably 1 to 8 total carbon atoms (e.g., methoxy, ethoxy, 2-methoxyethoxy, and 2-phenylethoxy), an aryloxy group having 6 to 20 total carbon atoms, preferably 6 to 12 total carbon atoms, and more preferably 6 to 10 total carbon atoms (e.g., phenoxy, p-methylphenoxy, p-chlorophenoxy, and naphthoxy), an acyl group having 1 to 20 total carbon atoms, preferably 2 to 12 total carbon atoms, and more preferably 2 to 8 total carbon atoms (e.g., acetyl, benzoly, and trichloroacetyl), an acyloxy group having 1 to 20 total carbon atoms, preferably 2 to 12 total carbon atoms, and more preferably 2 to 8 total carbon atoms (e.g., acetyloxy and benzoyloxy), an acylamino group having 1 to 20 total carbon atoms, preferably 2 to 12 total carbon atoms, and more preferably 2 to 8 total carbon atoms (e.g., acetylamino), a sulfonyl group having 1 to 20 total carbon atoms, preferably 1 to 10 total carbon atoms, and more preferably 1 to 8 total carbon atoms (e.g., methanesulfonyl, ethanesulfonyl, and benzenesulfonyl), a sulfinyl group having 1 to 20 total carbon atoms, preferably 1 to 10 total carbon atoms, and more preferably 1 to 8 total carbon atoms (e.g., methanesulfinyl and benzenesulfinyl), a sulfonylamino group having 1 to 20 total carbon atoms, preferably 1 to 10 total carbon atoms, and more preferably 1 to 8 total carbon atoms (e.g., methanesulfonylamino, ethanesulfonylamino, and benzenesulfonylamino), an amino group, a substituted amino group having 1 to 20 total carbon atoms, preferably 1 to 12 total carbon atoms, and more preferably 1 to 8 total carbon atoms (e.g., methylamino, dimethylamino, benzylamino, anilino, and diphenylamino), an ammonium group having 0 to 15 total carbon atoms, preferably 3 to 10 total carbon atoms, and more preferably 3 to 6 total carbon atoms (e.g., a trimethylammonium group and a triethylammonium group), a hydrazino group having 0 to 15 total carbon atoms, preferably 1 to 10 total carbon atoms, and more preferably 1 to 6 total carbon atoms (e.g., a trimethylhydrazino group), a ureido group having 1 to 15 total carbon atoms, preferably 1 to 10 total carbon atoms, and more preferably 1 to 6 total carbon atoms (e.g., a ureido group and an N,N-dimethylureido group), an imide group having 1 to 15 total carbon atoms, preferably 1 to 10 total carbon atoms, and more preferably 1 to 6 total carbon atoms (e.g., a succinimide group), an alkylthio or arylthio group having 1 to 20 total carbon atoms, preferably 1 to 12 total carbon atoms, and more preferably 1 to 8 total carbon atoms (e.g., methylthio, ethylthio, carboxyethylthio, sulfobutylthio, and phenylthio), an alkoxycarbonyl group having 2 to 20 total carbon atoms, preferably 2 to 12 total carbon atoms, and more preferably 2 to 8 total carbon atoms (e.g., methoxycarbonyl, ethoxycarbonyl, and benzyloxycarbonyl), an aryloxycarbonyl group having 6 to 20 total carbon atoms, preferably 6 to 12 total carbon atoms, and more preferably 6 to 8 total carbon atoms (e.g., phenoxycarbonyl), a nonsubstituted alkyl group having 1 to 18 total carbon atoms, preferably 1 to 10 total carbon atoms, and more preferably 1 to 5 total carbon atoms (e.g., methyl, ethyl, propyl, and butyl), a substituted alkyl group having 1 to 18 total carbon atoms, preferably 1 to 10 total carbon atoms, and more preferably 1 to 5 total carbon atoms (e.g., hydroxymethyl, trifluoromethyl, benzyl, carboxylethyl, ethoxycarbonylmethyl, and acetylaminomethyl assume that this substituted alkyl group also includes an unsatu-rated hydrocarbon group having 2 to 18 total carbon atoms, preferably 3 to 10 total carbon atoms, and more preferably 3 to 5 total carbon atoms (e.g., a vinyl group, an ethynyl group, a 1-cyclohexenyl group, a benzylidyne group, and a benzylidene group)), a substituted or nonsubstituted aryl group having 6 to 20 total carbon atoms, preferably 6 to 15 total carbon atoms, and more preferably 6 to 10 total carbon atoms (e.g., phenyl, naphthyl, p-carboxyphenyl, p-nitrophenyl, 3,5-dichlorophenyl, p-cyanophenyl, m-fluorophenyl, and p-tolyl), and a heterocyclic group which has 1 to 20 total carbon atoms, preferably 2 to 10 total carbon atoms, and more preferably 4 to 6 total carbon atoms and can be substituted (e.g., pyridyl, 5-methylpyridyl, thienyl, furyl, morpholino, and tetrahydrofurfuryl). The substituent group V can also form a ring to make a condensed benzene ring or a condensed naphthalene ring.

The substituent group V can be further substituted by the substituent groups mentioned above for the substituent group V.

The substituent groups on $Z_1$, $Z_2$, $Z_3$, $Z_4$, $Z_6$, and $Z_8$ are preferably an alkyl group, an aryl group, an alkoxy group, a halogen atom, an acyl group, a cyano group, a sulfonyl group, and a condensed benzene ring, more preferably an alkyl group, an aryl group, a halogen atom, an acyl group, a sulfonyl group, and benzene ring condensation, and particularly preferably methyl, phenyl, methoxy, a chlorine atom, a bromine atom, an iodine atom, and a condensed benzene ring.

Each of $R_1$, $R_2$, $R_3$, $R_5$, and $R_7$ in formulas (II-1), (II-2), and (II-3) represents an alkyl group. Examples of an alkyl group represented by $R_1$ and $R_2$ are a unsubstituted alkyl group having 1 to 18, preferably 1 to 7, and particularly preferably 1 to 4 carbon atoms (e.g., methyl, ethyl, propyl, isopropyl, butyl, isobutyl, hexyl, octyl, dodecyl, and octadecyl), and a substituted alkyl group having 1 to 18, preferably 1 to 7, and particularly preferably 1 to 4 total carbon atoms {e.g., a heterocyclic group substituted by the substituent group V which is enumerated as a substituent group for $Z_1$ and so on described above; preferable examples are an aralkyl group (e.g., benzyl and 2-phenylethyl), an unsaturated hydrocarbon group (e.g., an allyl group), a hydroxyalkyl group (e.g., 2-hydroxyethyl and 3-hydroxylpropyl), a carboxyalkyl group (e.g., 2-carboxyethyl, 3-carboxypropyl, 4-carboxybutyl, and carboxymethyl), an alkoxyalkyl group (e.g., 2-methoxyethyl and 2-(2-methoxyethoxy)ethyl), an aryloxyalkyl group (e.g., 2-phenoxyethyl and 2-(1-naphthoxy)ethyl), an alkoxycarbonylalkyl group (e.g., ethoxycarbonylmethyl and 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 3-sulfo-2-methylpropyl, 3-sulfopentyl, 3-sulfo-3-phenylpropyl, 2-[3-sulfopropoxy]ethyl, 2-hydroxy-3-sulfopropyl, and 3-sulfopropoxyethoxyethyl), a sulfoalkenyl group (e.g., 3-sulfo-2-propenyl), a sulfoaralkyl group (e.g., a 2-sulfobenzyl), a sulfatoalkyl group (e.g., a 2-sulfatoethyl, 3-sulfatopropyl, and 4-sulfatobutyl), a heterocyclic ring-substituted alkyl group (e.g., 2-(pyridine-2-one-1-yl)ethyl and tetrahydrofurfuryl), and a group (e.g., a methanesulfonylcarbamoylmethyl) represented by R in formula (II)}.

Alkyl groups represented by $R_1$, $R_2$, $R_3$, $R_5$, and $R_7$ are preferably a carboxylalkyl group, a sulfoalkyl group, a sulfoalkenyl group, a sulfoaralkyl group, a sulfatoalkyl group, and the groups represented by R in formula (II), and more preferably a sulfoalkyl group, a sulfoalkenyl group, and the groups represented by R in formula (II).

$Z_5$ represents atoms required to form an acidic nucleus and can take the form of an acidic nucleus of any general merocyanine dye. An acidic nucleus herein mentioned is defined in James ed., "The Theory of the Photographic Process", the 4th ed., Macmillan, 1977, page 198. Practical examples are described in U.S. Pat. Nos. 3,567,719, 3,575,869, 3,804,634, 3,837,862, 4,002,480, and 4,925,777, and JP-A-3-167546.

An acidic nucleus preferably forms a 5- or 6-membered nitrogen-containing heterocyclic ring consisting of carbon, nitrogen, and chalcogen (typically oxygen, sulfur, selenium, and tellurium) atoms, and examples are the following nuclei.

Nuclei of 2-pyrazoline-5-one, pyrazolidine-3,5-dione, imidazoline-5-one, hydantoin, 2- or 4-thiohydantoin, 2-iminoxazolidine-4-one, 2-oxazoline-5-one, 2-thioxazoline-2,4-dione, isoxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido[1,2-a]pyrimidine-1,3-dione, pyrazolo[1,5-b]quinazolone, pyrazolo[1,5-a]benzoimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxi de.

$Z_5$ is preferably hydantoin, 2- or 4-thiohydantoin, 2-oxazoline-5-one, 2-thioxazoline-2,4-dione, thiazolidine-2,4-dione, rhodanine, thiazolidine-2,4-dithione, barbituric acid, or 2-thiobarbituric acid, more preferably hydantoin, 2- or 4-thiohydantoin, 2-oxazoline-5-one, rhodanine, barbituric acid, or 2-thiobarbituric acid, and particularly preferably 2- or 4-thiohydantoin, 2-oxazoline-5-one, or rhodanine.

A 5- or 6-membered nitrogen-containing heterocyclic ring formed with $Z_7$ is a compound formed by removing an oxo group or a thioxo group from a heterocyclic ring represented by $Z_5$. $Z_7$ is preferably a compound formed by removing an oxo group or a thioxo group from hydantoin, 2- or 4-thiohydantoin, 2-oxazoline-5-one, 2-thioxazoline-2,4-dione, thiazolidine-2,4-dione, rhodanine, thiazolidine-2,4-dithione, barbituric acid, or 2-thiobarbituric acid, more preferably a compound formed by removing an oxo group or a thioxo group from hydantoin, 2- or 4-thiohydantoin, 2-oxazoline-5-one, rhodanine, barbituric acid, or 2-thiobarbituric acid, and particularly preferably a compound formed by removing an oxo group or a thioxo group from 2- or 4-thiohydantoin, 2-oxazoline-5-one, or rhodanine.

Examples of an alkyl group represented by $R_4$ and $R_6$ are a unsubstituted alkyl group and a substituted alkyl group enumerated as examples of $R_1$ described above, and the compounds that were mentioned above as preferable compounds of $R_1$ are preferable. Examples are a unsubstituted aryl group having 6 to 20 carbon atoms, preferably 6 to 10 carbon atoms, and more preferably 6 to 8 carbon atoms (e.g., a phenyl and a 1-naphthyl), a substituted aryl group having 6 to 20 total carbon atoms, preferably 6 to 10 total carbon atoms, and more preferably 6 to 8 total carbon atoms (e.g., an aryl group substituted by the substituent group V which is enumerated as a substituent group for $Z_1$ and so on described above; practical examples are p-methoxyphenyl, p-methylphenyl, and p-chlorophenyl), a unsubstituted heterocyclic group having 1 to 20 carbon atoms, preferably 3 to 10 carbon atoms, and more preferably 4 to 8 carbon atoms (e.g., 2-furyl, 2-thienyl, 2-pyridyl, 3-pyrazolyl, 3-isoxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), and 5-tetrazolyl), and a substituted heterocyclic group having 1 to 20 total carbon atoms, preferably 3 to 10 total carbon atoms, and more preferably 4 to 8 total carbon atoms (e.g., a heterocyclic group substituted by the substituent group V which is enumerated as a substituent group for $Z_1$ and so on described above; practical examples are 5-methyl-2-thienyl and 4-methoxy-2-pyridyl).

$R_4$ and $R_6$ are preferably methyl, ethyl, 2-sulfoethyl, 3-sulfopropyl, 3-sulfobutyl, 4-sulfobutyl, carboxymethyl, phenyl, 2-pyridyl, and 2-thiazolyl, and more preferably ethyl, 2-sulfoethyl, carboxymethyl, phenyl, and 2-pyridyl.

R in formula (II) will be described below.

Each of $Q_a$, $Q_b$, $Q_c$, and $Q_d$ is a unsubstituted methylene group or a substituted methylene group (e.g., a methylene group substituted by the substituent group V described above; practical examples are methyl group-substituted methylene, ethyl group-substituted methylene, phenyl group-substituted methylene, hydroxy group-substituted methylene, and halogen atom (e.g., a chlorine atom or a bromine atom)-substituted methylene), and preferably a unsubstituted methylene group.

Each of $R_a$, $R_b$, $R_c$, and $R_d$ represents an alkyl group, an aryl group, a heterocyclic group, an alkoxy group, an aryloxy group, or an amino group. Preferable alkyl groups, aryl groups, and heterocyclic groups are those enumerated as preferable for $R_4$ and $R_6$ described above. An example of an alkoxy group is an alkoxy group having 1 to 20 total carbon atoms, preferably 1 to 10 total carbon atoms, and more preferably 1 to 8 total carbon atoms (e.g., methoxy, ethoxy, 2-methoxyethoxy, and 2-hydroxyethoxy), an example of an aryloxy group is an aryloxy group having 6 to 20 total carbon atoms, preferably 6 to 12 total is carbon atoms, and more preferably 6 to 10 total carbon atoms (e.g., phenoxy, p-methylphenoxy, p-chlorophenoxy, and naphthoxy), and an example of an amino group is an amino group having 0 to 20 total carbon atoms, preferably 0 to 12 total carbon atoms, and more preferably 0 to 8 total carbon atoms (e.g., amino, methylamino, dimethylamino, ethylamino, hydroxyethylamino, benzylamino, anilino, diphenylamino, morpholino that formed a ring, and pyrrolidino). These substituent groups can be further substituted by the substituent group V described previously. Each of Ra, Rb, Rc, and Rd is more preferably methyl, ethyl, or hydroxyethyl, and particularly preferably methyl.

Each of r, t, s, and u represents any integer from 0 to 10, preferably 1, 2, 3, 4, or 5, more preferably 1, 2, or 3, and particularly preferably 1. If r, t, s, and u are 2 or more, methylene groups are repeated but they need not be identical.

Note that all Rs in the present invention are expressed in dissociated forms, but they can also take an undissociated form as represented by R' below.

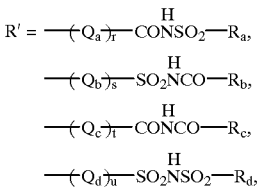

In practical examples of the compound represented by formula (II) of the present invention, the combination of R and a charge-balancing counterion ($H^+$) is used as a method of expressing R' as follows.

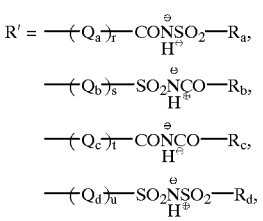

It depends upon the pH of the sensitive material whether a compound represented by formula (II) has a dissociated form R or an undissociated form R'.

Practical examples of R in formula (II) are presented below.

| R (Dissociated State) | R' (Undissociated State) |
|---|---|
| $-(CH_2)_3CON^{\ominus}-SO_2CH_3$ | $-(CH_2)_3CONHSO_2CH_3$ |
| $-(CH_2)_2CON^{\ominus}-SO_2CH_3$ | $-(CH_2)_2CONHSO_2CH_3$ |
| $-CH_2-CONSO_2CH_3$ | $-CH_2CONHSO_2CH_3$ |
| $-(CH_2)_4SO_2N^{\ominus}-COCH_3$ | $-(CH_2)_4SO_2NHCOCH_3$ |
| $-(CH_2)_3SO_2N^{\ominus}-COCH_3$ | $-(CH_2)_3SO_2NHCOCH_3$ |
| $-(CH_2)_2SO_2N^{\ominus}-COCH_3$ | $-(CH_2)_2SO_2NHCOCH_3$ |

-continued

| R (Dissociated State) | R' (Undissociated State) |
|---|---|
| $-CH_2-SO_2N^{\ominus}-COCH_3$ | $-CH_2SO_2NHCOCH_3$ |
| $-CH_2CON^{\ominus}-SO_2C_2H_5$ | $-CH_2CONHSO_2C_2H_5$ |
| $-CH_2CON^{\ominus}-SO_2N(CH_3)_2$ | $-CH_2CONHSO_2N(CH_3)_2$ |

Each of $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, and $L_{22}$ independently represents a methine group. A methine group represented by $L_1$ to $L_{22}$ can have a substituent group. Examples of the substituent group are a substituted or unsubstituted alkyl group having 1 to 15 total carbon atoms, preferably 1 to 10 total carbon atoms, and more preferably 1 to 5 total carbon atoms (e.g., methyl, ethyl, and 2-carboxyethyl), a substituted or unsubstituted aryl group having 6 to 20 total carbon atoms, preferably 6 to 15 total carbon atoms, and more preferably 6 to 10 total carbon atoms (e.g., phenyl and o-carboxyphenyl), a substituted or unsubstituted heterocyclic group having 3 to 20 total carbon atoms, preferably 4 to 15 total carbon atoms, and more preferably 6 to 10 total carbon atoms (e.g., an N,N-diethylbarbiturate group), a halogen atom (e.g., chlorine, bromine, fluorine, and iodine), an alkoxy group having 1 to 15 total carbon atoms, preferably 1 to 10 total carbon atoms, and more preferably 1 to 5 total carbon atoms (e.g., methoxy and ethoxy), an alkylthio group having 1 to 15 total carbon atoms, preferably 1 to 10 total carbon atoms, and more preferably 1 to 5 total carbon atoms (e.g., methylthio and ethylthio), an arylthio group having 6 to 20 total carbon atoms, preferably 6 to 15 total carbon atoms, and more preferably 6 to 10 total carbon atoms (e.g., phenylthio), and an amino group having 0 to 15 total carbon atoms, preferably 2 to 10 total carbon atoms, and more preferably 4 to 10 total carbon atoms (e.g., N,N-diphenylamino, N-methyl-N-phenylamino, and N-methylpiperazino). These methine groups can form a ring together with another methine group or can also form a ring with an auxochrome.

Each of $n_1$, $n_2$, and $n_3$ is preferably 0 or 1, and more preferably 1. $n_4$ is preferably 0 or 1, and more preferably 0. If $n_1$, $n_2$, $n_3$, and $n_4$ are 2 or more, methine groups are repeated but they need not be the same.

When it is required to neutralize the ion charge of a dye, $M_1$, $M_2$, $M_3$, and $M_4$ are included in a formula to indicate the existence of a cation or an anion. Typical examples of the cation are inorganic cations such as a hydrogen ion ($H^+$), an alkali metal ion (e.g., a sodium ion, a potassium ion, and a lithium ion), and an alkali earth metal ion (e.g., a calcium ion), and organic ions such as an ammonium ion (e.g., an ammonium ion, a tetraalkylammonium ion, a pyridinium ion, and an ethylpyridinium ion). The anion can be either an inorganic anion or an organic anion. Examples are a halogen anion (e.g., a fluorine ion, a chlorine ion, and an iodine ion), a substituted arylsulfonate ion (e.g., a p-toluenesulfonate ion and a p-chlorobenzenesulfonate ion), an aryldisulfonate ion (e.g., a 1,3-benzenesulfonate ion, a 1,5-naphthalenedisulfonate ion, and a 2,6-naphthalenedisulfonate ion), an alkyl sulfate ion (e.g., a methyl sulfate ion), a sulfate ion, a thiocyanate ion, a perchlorate ion, a tetrafluoroborate ion, a picrate ion, an acetate ion, and a trifluoromethanesulfonate ion. It is also possible to use an ionic polymer or a dye having the opposite electric charge to the dye represented by formula (II).

Each of $m_1$, $m_2$, $m_3$, and $m_4$ represents a number necessary to balance the electric charge, and is 0 if a salt is formed in a molecule.

Each of $p_1$, $p_2$, $p_3$, $p_4$, $p_5$, and $p_6$ independently represents 0 or 1 and is preferably 0.

Of formulas (II-1), (II-2), and (II-3), formula (II-1) is most preferable. In formula (II-1), it is preferable that $n_1$ be 1 and each of $Z_2$ and $Z_3$ forms a benzoxazole nucleus or a benzothiazole nucleus. It is more preferable that $R_1$ be the group represented by R in formula (II), and $R_2$ be the sulfoalkyl group, the sulfoalkenyl group, or the sulfoaralkyl group, examples of which are those mentioned above.

Practical examples of compounds represented by formula (II) (including formulas (II-1), (II-2), and (II-3) as the lower conceptions) of the present invention are presented below. However, the present invention is not limited to these examples.

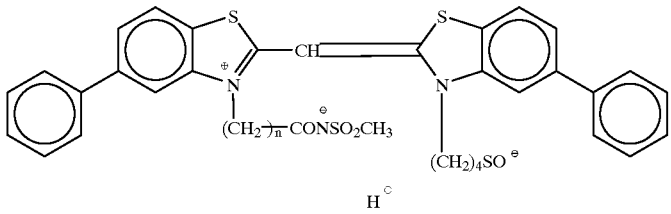

(1) n = 1 (2) n = 2 (3) n = 3

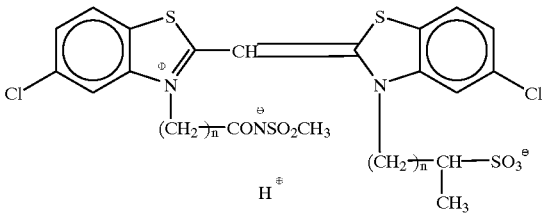

(4) n = 1 (5) n = 2 (6) n = 3

(7)

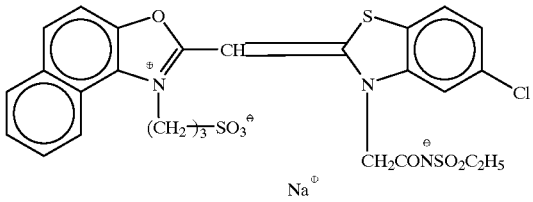

(8)

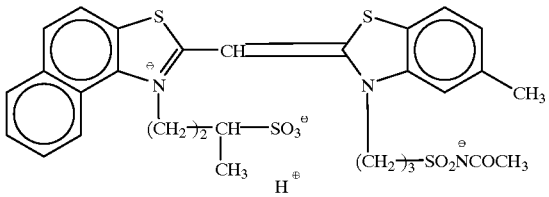

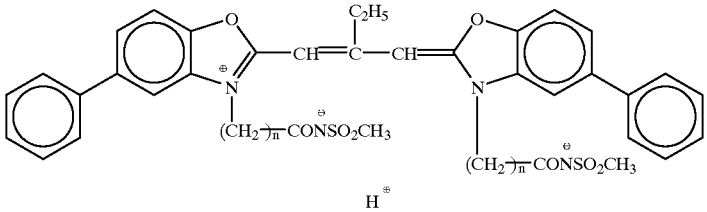

(9) n = 1

(10) n = 3

-continued
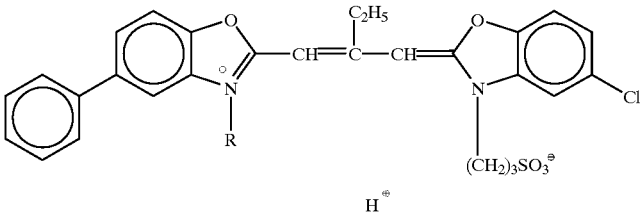
(11) R = $(CH_2)_3\overset{\ominus}{C}ONSO_2CH_3$
(12) R = $(CH_2)_3SO_2\overset{\ominus}{N}COCH_3$
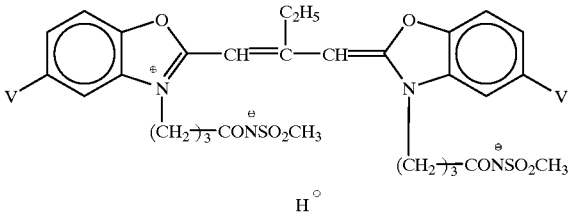
(13) V = Br
(14) V = I
(15)
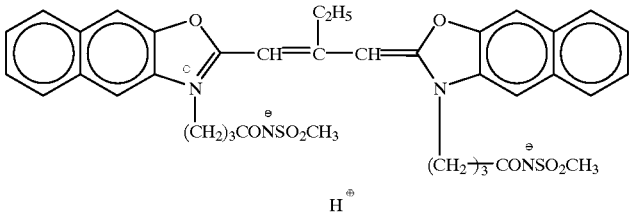
(16)
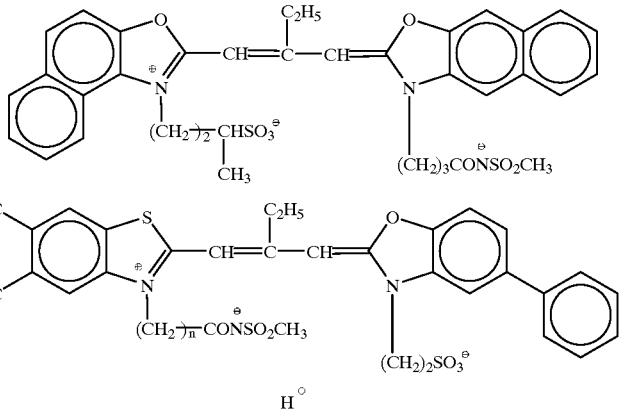
(17) n = 1
(18) n = 2
(19) n = 3
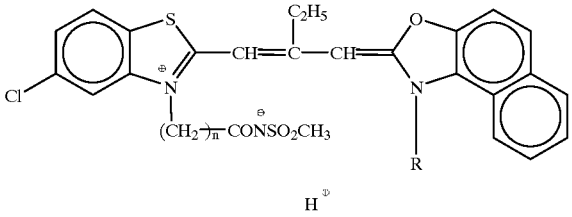
(20) n = 1, R = $(CH_2)_3SO_3^{\ominus}$ -continued
(21) n = 2, R = $(CH_2)_2CH(CH_3)SO_3^{\ominus}$
(22) n = 2, R = $CH_2CH{=}CHSO_3^{\ominus}$
(23) n = 1, R = $(CH_2)_2OSO_3^{\ominus}$
(24) n = 1, R = $CH_2CH(CH_3)CH_2SO_3^{\ominus}$
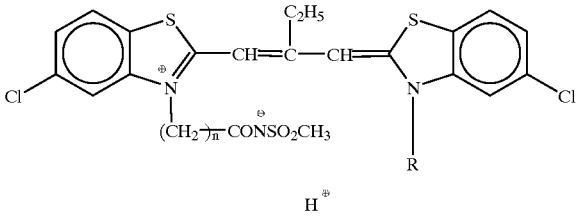
(25) n = 1, R = $(CH_2)_4SO_3^{\ominus}$
(26) n = 1, R = $(CH_2)_2CH(CH_3)SO_3^{\ominus}$
(27) n = 1, R = $CH_2CON^{\ominus}SO_2CH_3$
(28) n = 2, R = $(CH_2)_2CH(C_6H_5)SO_3^{\ominus}$
(29)
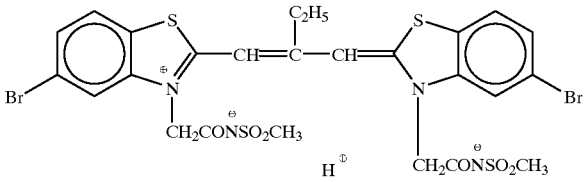
(30)
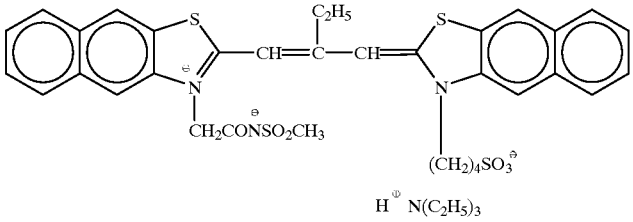
(31)
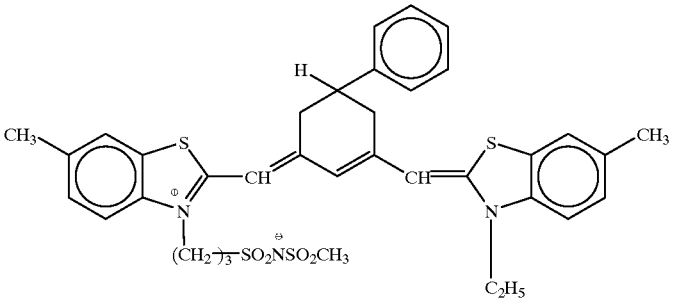

-continued
(32)
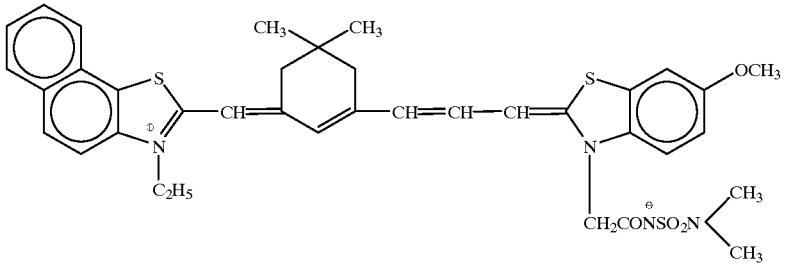
(33)
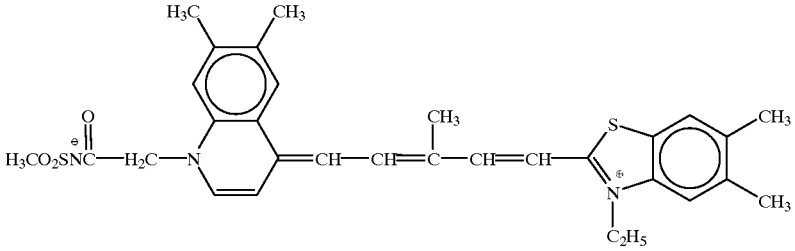
(34)
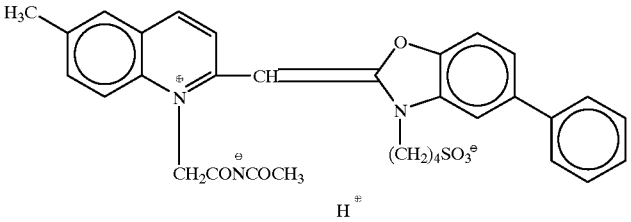
(35)
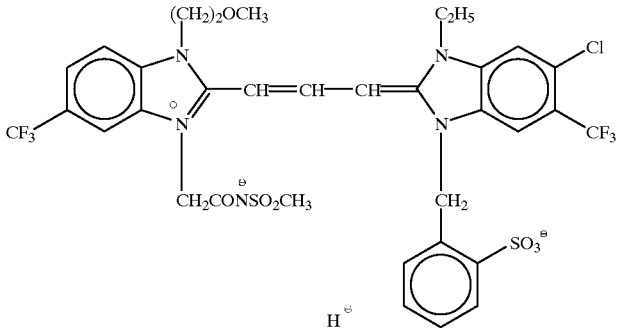
(36)
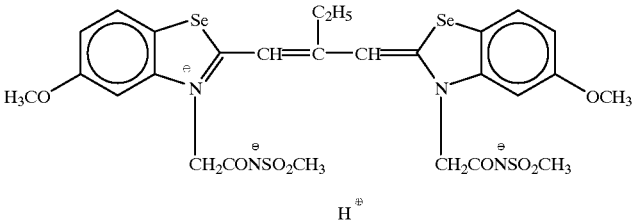

-continued
(37)
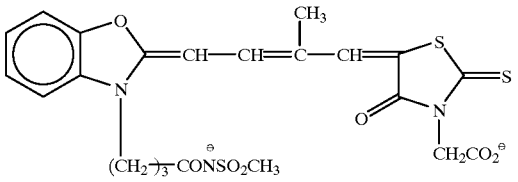
$(Na^{\oplus})_2$
(38)
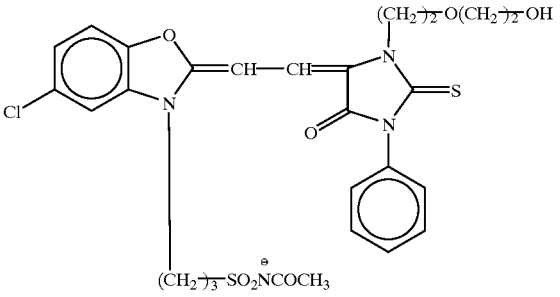
$Na^{\oplus}$
(39)
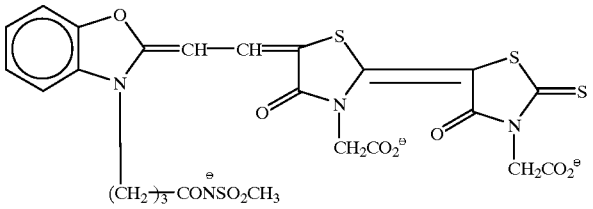
$(H^{\oplus})_3$
(40)
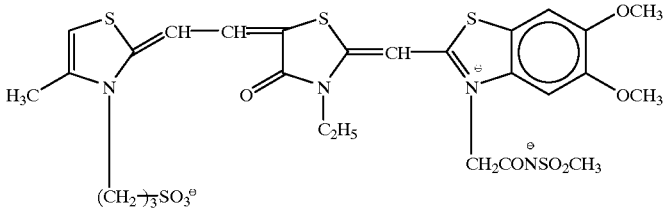
$Na^{\oplus}$
(41)
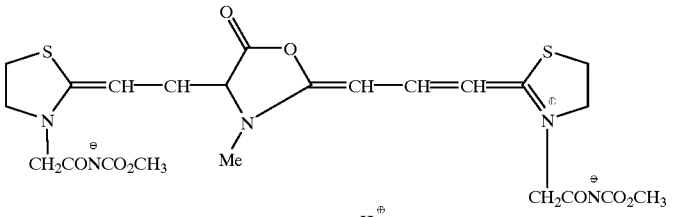
$H^{\oplus}$
(42)
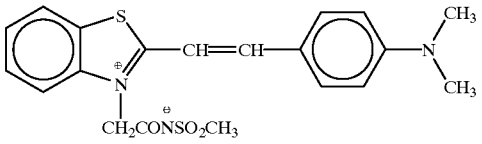

-continued (43)

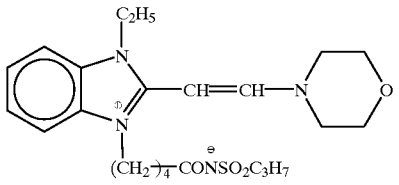

Compounds represented by formula (II) (formula (II) includes formulas (II-1), (II-2), and (II-3) as the lower conceptions) of the present invention can be synthesized on the basis of methods described in, e.g., F. M. Harmer, "Heterocyclic Compounds-Cyanine Dyes and Related Compounds", John Wiley & Sons, New York, London, 1964, D. M. Sturmer, "Heterocyclic Compounds-Special topics in heterocyclic chemistry", chapter 18, paragraph 14, items 482 to 515, John Wiley & Sons, New York, London, 1977, "Rodd's Chemistry of Carbon Compounds", 2nd. Ed., vol. IV, part B, 1977, chapter 15, items 369 to 422, Elsevier Science Publishing Company Inc., New York, and British Pat. No. 1,077,611. Synthesis example (synthesis of compound (20))

A compound (20) can be synthesized in accordance with a scheme presented below.

(20A)

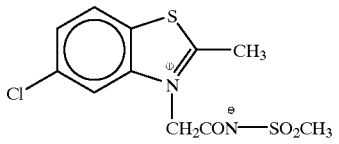

HBr

+

(20B)

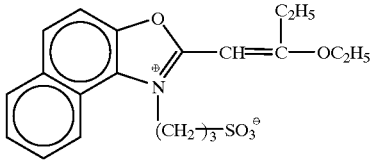

(20)

2 g (5 mmol) of (20A), 3.31 g (8.5 mmol) of (20B), 8 ml of dimethylsulfoxide, and 1.66 g (11 mmol) of 1,8-diazabicyclo[5,4,0]-7-undecene were stirred at room temperature for 1 hr, and 100 ml of ethyl acetate were added. The supernatant liquid was removed by decantation, the residue was dissolved by adding 20 ml of methanol, and the solution was purified through a sephadex column (Eluting solution methanol). The resultant crystal was dissolved by adding 20 ml of methanol, 1 ml of acetic acid was added to the solution, and the precipitated crystal was extracted by suction filtration and dried. The result was 0.36 g of reddish purple crystal (yield 10.9%, λmax=536 nm (ε=106000) decomposed at a melting point of 200° C. or more (in MeOH)).

The addition amount of a spectral sensitizing dye represented by formula (II) is preferably $0.5\times10^{-6}$ mol to $1.0\times10^{-2}$ mol, and more preferably $1.0\times10^{-5}$ mol to $5.0\times10^{-3}$ mol per mol of a silver halide in the light-sensitive silver halide emulsion.

Sensitizing dyes can be added in the course of forming silver halide grains, in the course of chemical sensitization, or when coating is performed. Sensitizing dyes can preferably be added before chemical sensitization.

As a method of adding sensitizing dyes during the formation of silver halide emulsion grains, U.S. Pat. Nos. 4,225,666 and 4,828,972 and JP-A-61-103149 can be referred to. As a method of adding sensitizing dyes in the step of desalting a silver halide emulsion, European Pat. No. 291,339-A and JP-A-64-52137 can be referred to. Also, JP-A-59-48756 can be referred to as a method of adding sensitizing dyes in the chemical sensitization step.

As a method of raising the spectral sensitization sensitivity by using sensitizing dyes, a method which uses a combination of two or more different sensitizing dyes is known. In the combination, a sensitizing dye that is outside the scope of formula (II) of the invention can also be used, as well as a sensitizing dye within the scope of formula (II) of the invention. When two or more different sensitizing dyes are combined, the spectral sensitivity often achieves the effect which is intermediate between the effects when the individual sensitizing dyes are singly used, or decreases. However, when a certain specific combination of sensitizing dyes is used, the spectral sensitivity sometimes significantly rises compared to cases where the individual sensitizing dyes are singly used. This phenomenon is usually called a supersensitization action of sensitizing dyes. The supersensitization action is summarized in T. H. James ed., "The Theory of the Photographic Process", the 4th ed., Macmillan, New York, 1977, chapter 10 (by W. West and P. B. Gilman).

When such a combination of sensitizing dyes is used, the peaks in the spectral sensitization wavelength sometimes becomes one peak at the intermediate between the peaks of the spectral sensitization wavelengths when the individual sensitizing dyes are singly used, or becomes plurality of peaks each of which are at the positions when the individual sensitizing dyes one singly used. However, the spectral sensitization sometimes transits to a wavelength unpredictable from the spectral sensitization characteristics when these sensitizing dyes are singly used.

It is an important object in the techniques of spectrally sensitizing silver halide photographic emulsions to use a combination of sensitizing dyes as described above to thereby obtain a higher sensitivity than when the individual sensitizing dyes are singly used, and to find out a combination of sensitizing dyes having a sensitization wavelength region meeting the intended use of a photographic sensitive material.

In a combination of sensitizing dyes used to obtain supersensitization, a significant selectivity is required between the dyes, and an apparently slight difference between the chemical structures has a significant effect on the supersensitization action. That is, a combination of sensitizing dyes by which the supersensitization action is obtained is difficult to predict simply from chemical structures.

As supersensitizers, it is possible to use dyes having no spectral sensitization action or substances which do not essentially absorb visible light. Examples are aminostyryl compounds substituted by a nitrogen-containing heterocyclic group (e.g., compounds described in U.S. Pat. Nos. 2,933,390 and 3,635,721), aromatic organic acid formaldehyde condensates (e.g., condensates described in U.S. Pat. No. 3,743,510), cadmium salt, and an azaindene compound. Combinations described in U.S. Pat. Nos. 3,615,613, 3,615,641, 3,617,295, and 3,635,721 are particularly useful.

Details of formula (III) will be described below.

Formula (III)

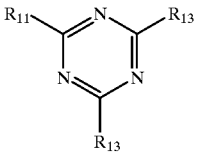

In formula (III), $R_{11}$, $R_{12}$, and $R_{13}$ can be the same or different and each represents a hydroxy group, an amino group, an alkylamino group, an arylamino group, an alkoxy group, an aryloxy group, an alkyl group, an aryl group, an alkylthio group, an arylthio group, or a group represented by formula (IV) below. Note that at least one of $R_{11}$, $R_{12}$, and $R_{13}$ is a group represented by formula (IV) below.

Formula (IV)

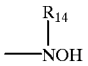

In formula (IV), $R_{14}$ represents a hydrogen atom, an alkyl group, an alkenyl group, or an aryl group.

$R_{11}$, $R_{12}$, $R_{13}$, and $R_{14}$ in a compound represented by formula (III) in the present invention will be described in detail below.

$R_{11}$, $R_{12}$, and $R_{13}$ can be the same or different and each represents a hydroxy group, an amino group, an alkylamino group, an arylamino group, an alkoxy group, an aryloxy group, an alkyl group, an aryl group, an alkylthio group, an arylthio group, or a group represented by formula (IV) below. Note that at least one of $R_{11}$, $R_{12}$, and $R_{13}$ is a group represented by formula (IV) below.

Formula (IV)

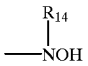

In formula (IV), $R_{14}$ represents a hydrogen atom, an alkyl group, an alkenyl group, or an aryl group.

If each of $R_{11}$, $R_{12}$, and $R_{13}$ is an alkylamino group, an arylamino group, an alkoxy group, an aryloxy group, an alkyl group, an aryl group, an alkylthio group, or an arylthio group, these groups can have substituent groups. Examples of the substituent groups are a hydroxy group, an alkoxy group (having preferably 1 to 4 carbon atoms, particularly preferably 1 or 2 carbon atoms), an amino group, and an alkylamino group (a mono- or di-substituted amino group having preferably 1 to 4 carbon atoms, and particularly preferably 1 or 2 carbon atoms).

If each of $R_{11}$, $R_{12}$, and $R_{13}$ is an aryl group, examples of the substituent groups further include an alkyl group (having preferably 1 to 4 carbon atoms, and particularly preferably 1 or 2 carbon atoms) in addition to the above substituent groups starting from the hydroxy group to the alkylamino group.

If $R_{14}$ is an alkyl group, an alkenyl group, or an aryl group, these groups can have substituent groups, and examples are the same as described above for $R_{11}$.

If each of $R_{11}$, $R_{12}$, and $R_{13}$ is an alkylamino group, this alkylamino group is a mono- or di-substituted amino group having 1 to 12 carbon atoms, preferably 1 to 5 carbon atoms. Examples are methylamino, ethylamino, isopropylamino, 2-hydroxyethylamino, diethylamino, benzylamino, 2-methanesulfonamidoethylamino, bis(2-carboxyethyl) amino, 3-methoxypropylamino, and n-dodecylamino.

If each of $R_{11}$, $R_{12}$, and $R_{13}$ is an arylamino group, this arylamino group is a mono- or di-substituted anilino group having 6 to 24 carbon atoms, preferably 6 to 10 carbon atoms. Examples are anilino, naphthylamino, 2-methylanilino, 4-methoxyanilino, 3-dimethylaminoanilino, and N-methylanilino.

If each of $R_{11}$, $R_{12}$, and $R_{13}$ is an alkoxy group, this alkoxy group has 1 to 12 carbon atoms, preferably 1 to 15 carbon atoms. Examples are methoxy, ethoxy, isopropyloxy, 2-hydroxyethoxy, 3-methoxypropyloxy, benzyloxy, and n-dodecyloxy.

If each of $R_{11}$, $R_{12}$, and $R_{13}$ is an aryloxy group, this aryloxy group has 6 to 24 carbon atoms, preferably 6 to 10 carbon atoms. Examples are phenoxy, naphthyloxy, 4-methoxyphenoxy, and 2-methylphenoxy.

If each of $R_{11}$, $R_{12}$, and $R_{13}$ is an alkyl group, this alkyl group is a straight-chain, branched-chain, or cyclic alkyl group having 1 to 10 carbon atoms, preferably 1 to 5 carbon atoms. Examples are methyl, ethyl, propyl, isopropyl, t-butyl, 2-hydroxyethyl, 3-hydroxypropyl, benzyl, 2-methanesulfonamidoethyl, 2-methoxyethyl, cyclopentyl, 2-acetamidoethyl, 2-carboxyethyl, 2,3-dihydroxypropyl, n-hexyl, n-decyl, and 2-sulfoethyl.

If each of $R_{11}$, $R_{12}$, and $R_{13}$ is an aryl group, this aryl group has 6 to 16 carbon atoms, preferably 6 to 10 carbon atoms. Examples are a phenyl, naphthyl, 2-methylphenyl, 3-ethylphenyl, 4-methoxyphenyl, 3-dimethylaminophenyl, 4-trifluoromethylphenyl, and 2,4,5-trichlorophenyl.

If each of $R_{11}$, $R_{12}$, and $R_{13}$ is an alkylthio group, this alkylthio group has 1 to 12 carbon atoms, preferably 1 to 5 carbon atoms. Examples are methylthio, ethylthio, isopropylthio, 2-hydroxyethylthio, 3-methoxypropylthio, benzylthio, and n-dodecylthio.

If each of $R_{11}$, $R_{12}$, and $R_{13}$ is an arylthio group, this arylthio group has 6 to 24 carbon atoms, preferably 6 to 10 carbon atoms. Examples are phenylthio, naphthylthio, 4-methoxyphenylthio, and 2-methylphenylthio.

If $R_{14}$ is an alkyl group, this alkyl group is a straight-chain, branched-chain, or cyclic alkyl group having 1 to 10 carbon atoms, preferably 1 to 5 carbon atoms. Examples are methyl, ethyl, propyl, isopropyl, t-butyl, 2-hydroxyethyl, 3-hydroxypropyl, benzyl, 2-methanesulfonamidoethyl, 2-methoxyethyl, cyclopentyl, 2-acetamidoethyl, 2-carboxyethyl, 2,3-dihydroxypropyl, n-hexyl, n-decyl, and 2-sulfoethyl.

If $R_{14}$ is an alkenyl group, this alkenyl group is a straight-chain, branched-chain, or cyclic alkyl group having 1 to 10 carbon atoms, preferably 1 to 5 carbon atoms. Examples are allyl, 2-butenyl, and 5-hexenyl.

If $R_{14}$ is an aryl group, this aryl group has 6 to 16 carbon atoms, preferably 6 to 10 carbon atoms. Examples are phenyl, naphthyl, 2-methylphenyl, 3-ethylphenyl, 4-methoxyphenyl, 3-dimethylaminophenyl, 4-trifluoromethylphenyl, and 2,4,5-trichlorophenyl.

Preferable combinations of $R_{11}$, $R_{12}$, $R_{13}$, and $R_{14}$ in formula (III) will be described below.

A compound represented by formula (III) preferably has a total carbon atoms of 3 to 15.

It is more preferable that each of $R_{11}$, $R_{12}$, and $R_{13}$ consist of only an alkylamino group and a group represented by formula (IV).

If this is the case, it is further preferable that the total carbon atoms of this compound be 10 or less.

It is particularly preferable that at least two of $R_{11}$, $R_{12}$, and $R_{13}$ be groups represented by formula (IV).

Practical examples of representative compounds represented by formula (III) in the present invention are presented below. However, the present invention is not limited to these examples.

(H-1)

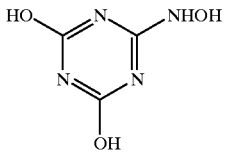

(H-2)

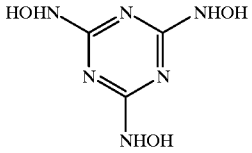

(H-3)

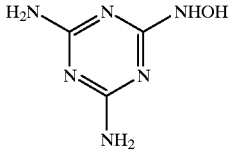

(H-4)

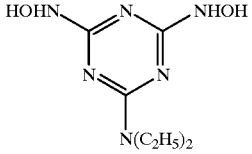

(H-5)

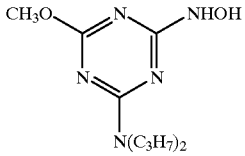

(H-6)

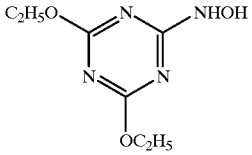

-continued (H-7)

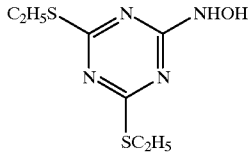

(H-8)

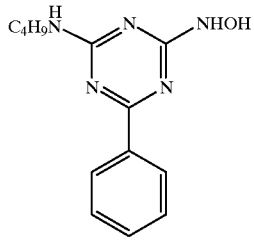

(H-9)

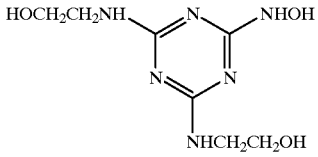

(H-10)

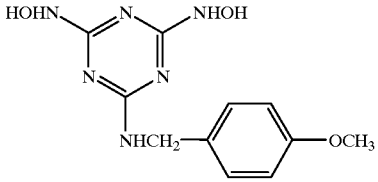

(H-11)

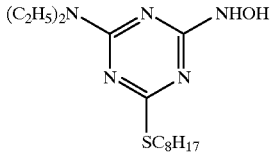

(H-12)

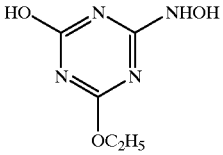

(H-13)

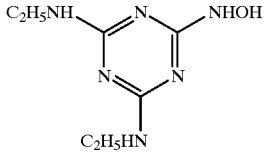

(H-14)

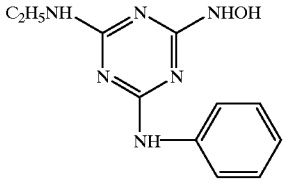

-continued (H-15)

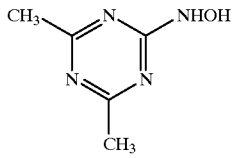

(H-16)

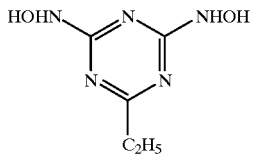

(H-17)

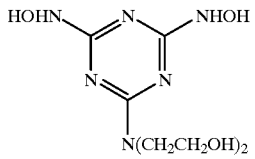

(H-18)

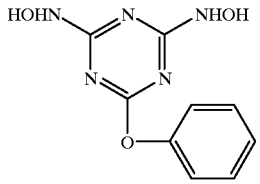

(H-19)

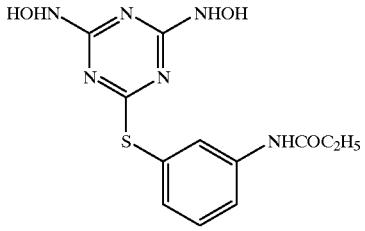

(H-20)

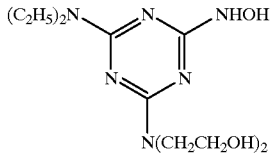

(H-21)

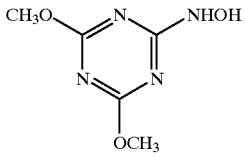

(H-22)

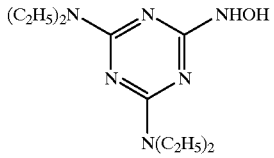

-continued (H-23)

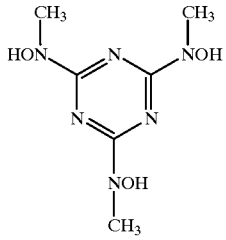

(H-24)

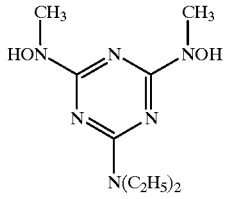

(H-25)

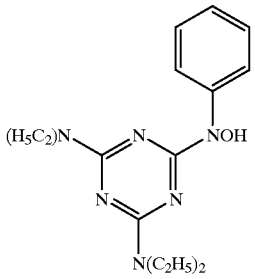

(H-26)

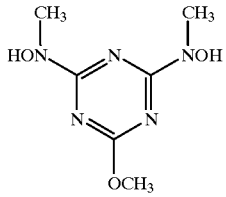

Compounds represented by formula (III) of the present invention can be synthesized by methods of synthesis described in, e.g., "Journal Of The Organic Chemistry", Vol. 27, page 4054 (1962), "Journal Of The American Chemical Society", Vol. 73, page 2981 (1951), and Jpn. Pat. Appln. KOKOKU Publication No. (hereinafter referred to as JP-B-) 49-10692.

The addition amount of a compound of formula (III) is preferably $0.5\times10^{-6}$ mol to $1.0\times10^{-2}$ mol, and more preferably $1.0\times10^{-5}$ mol to $5.0\times10^{-3}$ mol per mol of a silver halide in the light-sensitive silver halide emulsion.

A compound of formula (III) can be added in any of a formation process, a chemical sensitization process, and a coating process of silver halide grains. However, a compound is preferably added before the addition of a chemical sensitizer in the chemical sensitization process.

The process of manufacturing a silver halide emulsion is roughly divided into steps of grain formation, desalting, and chemical sensitization. The grain formation step is subdivided into nucleation, ripening, and growth. These steps are not performed in a predetermined order, i.e., they are performed in a reverse order or repeatedly. Performing reduction sensitization during the manufacture of a silver halide emulsion means herein that the reduction sensitization can be basically performed in any of these steps. That is, the reduction sensitization can be performed during nucleation or physical ripening, as the initial stages of the grain formation, during growth, or prior to or after chemical sensitization. If chemical sensitization using a gold sensitizer is to be performed, the reduction sensitization is preferably performed before the chemical sensitization so that an undesired fog is not produced. Most preferably, the reduction sensitization is performed during the growth of silver halide grains. This method of performing reduction sensitization during the growth herein includes a method of performing reduction sensitization while silver halide grains are being physically ripened or being grown upon addition of a water-soluble silver salt and a water-soluble alkali halide, and a method of performing reduction sensitization while temporarily stopping the growth and then performing the growth again.

Known methods of the reduction sensitization used in the present invention are a method of adding well-known reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. Two or more of these methods can be used together.

The method of adding reduction sensitizers is preferable in that the level of reduction sensitization can be finely adjusted.

Known examples of the reduction sensitizer are stannous chloride, amine and polyamic acid, a hydrazine derivative, formamidinesulfinic acid, a silane compound, and a borane compound. In the present invention, these known compounds can be selectively used. Also, two or more types of compounds can be used together. A compound used as the reduction sensitizer is preferably stannous chloride, thiourea dioxide, dimethylamineborane, or an alkinylamine compound described in U.S. Pat. No. 5,389,510, and more preferably thiourea dioxide. Although the addition amount of the reduction sensitizers depends upon the emulsion manufacturing conditions and must be so selected, the amount is $10^{-7}$ to $10^{-3}$ mol per mol of a silver halide in the light-sensitive silver halide emulsion.

As the reduction sensitizers of the present invention, ascorbic acid and its derivatives can also be used.

Practical examples of ascorbic acid and its derivatives (to be referred to as "ascorbic acid compounds" hereinafter) are as follows.

(A-1) L-ascorbic acid (A-2) L-sodium ascorbate (A-3) L-potassium ascorbate (A-4) DL-ascorbic acid (A-5) D-sodium ascorbate (A-6) L-ascorbic acid-6-acetate (A-7) L-ascorbic acid-6-palmitate (A-8) L-ascorbic acid-6-benzoate (A-9) L-ascorbic acid-5,6-diacetate (A-10) L-ascorbic acid-5,6-O-isopropyridene It is desirable that the ascorbic acid compound used in the present invention be used in an amount larger than the addition amount conventionally used for reduction sensitizers. For example, JP-B-57-33572 describes "The amount of a reducing agent does not usually exceed $0.75\times10^{-2}$ milliequivalent amount ($8\times10^{-4}$ mol/AgX mol) per g of silver ion. An amount of 0.1 to 10 mg per kg of silver nitrate ($10^{-7}$ to $10^{-5}$ mol/AgX mol as an amount of ascorbic acid) is effective in many instances." (the converted values in parentheses are calculated by the present inventors). U.S. Pat. No. 2,487,850 describes "an addition amount by which a tin compound can be used as a reduction sensitizer is $1\times10^{-7}$ to $44\times10^{-6}$ mol". JP-A-57-179835 describes that a proper addition amount of thiourea dioxide is about 0.01 mg to about 2 mg per mol of a silver halide and a proper addition amount of stannous chloride is about 0.01 mg to about 3 mg. A preferable addition amount of the ascorbic acid compound used in the present invention depends upon factors such as the grain size of an emulsion, the halogen composition, and the temperature, pH, and pAg during emulsion preparation. However, the addition amount is selected from preferably $5\times10^{-5}$ to $1\times10^{-1}$ mol, more preferably $5\times10^{-4}$ to $1\times10^{-2}$ mol, and particularly preferably $1\times10^{-3}$ to $1\times10^{-4}$ mol per mol of a silver halide in the light-sensitive silver halide emulsion. Thiourea dioxide is particularly preferable among other reduction sensitizers.

It is possible to dissolve the reduction sensitizers in water or a solvent such as alcohols, glycols, ketones, esters, or amides, and add the resultant solution during grain formation or before or after chemical sensitization. Reduction sensitizers can be added in any process of the emulsion manufacture, but it is particularly preferable to add reduction sensitizers during grain growth. Although adding to a reactor vessel in advance is also preferable, adding at a given timing during grain formation is more preferable. It is also possible to apply the reduction sensitizers to an aqueous solution of a water-soluble silver salt or a water-soluble alkali halide to form grains by using this aqueous solution. Alternatively, a method by which a solution of the reduction sensitizers is added separately several times or continuously over a long time period with the progress of grain growth is also preferable.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt sparingly soluble in water, such as a silver halide, silver sulfide, or silver selenide, or a silver salt easily soluble in water, such as silver nitrate. The oxidizer for silver can be either an inorganic or organic substance. Examples of the inorganic oxidizer are ozone, hydrogen peroxide and its adduct (e.g., $NaBO_2.\ H_2O_2.3H_2O$, $2NaCO_3.\ 3H_2O_2$, $Na_4P_2O_7.\ 2H_2O_2$, and $2Na_2SO_4.H_2O_2.\ 2H_2O$), peroxy acid salt (e.g., $K_2S_2O_8$, $K_2C_2O_6$, and $K_2P_2O_8$), a peroxy complex compound {e.g., $K_2(Ti(O_2)C_2O_4).\ 3H_2O$, $4K_2SO_4.\ Ti(O_2)OH.SO_4.\ 2H_2O$ , and $Na_3(VO(O_2)\ (C_2H_4)_2.6H_2O$}, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate. Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

A disulfide compound described in EP0627657A2 is used as a more preferable oxidizer.

Preferable oxidizers used in the present invention are ozone, hydrogen peroxide and its adduct, a halogen element, an inorganic oxidizer of thiosulfonate, and an organic oxidizer of quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

A silver halide photographic light-sensitive material of the present invention preferably contains at least one compound selected from compounds represented by formulas (XX), (XXI), and (XXII) below.

Formula (XX): $R_{101}$-$SO_2S$-$M_{101}$

Formula (XXI): $R_{101}$-$SO_2S$-$R_{102}$

Formula (XXII): $R_{101}$-$SO_2S$-$(E)_a SSO_2$-$R_{103}$ wherein each of $R_{101}$, $R_{102}$, and $R_{103}$ represents an aliphatic group, an aromatic group, or a heterocyclic group, $M_{101}$ represents a cation, E represents a divalent binding group, and a represents 0 or 1.

A compound of formula (XX), (XXI), or (XXII) will be described in more detail below. If each of $R_{101}$, $R_{102}$, and $R_{103}$ is an aliphatic group, this aliphatic group is preferably an alkyl group having 1 to 22 total carbon atoms or an alkenyl or alkinyl group having 2 to 22 total carbon atoms, and these groups can have substituent groups. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl group are allyl and butenyl.

Examples of the alkinyl group are propargyl and butynyl.

An aromatic group of $R_{101}$, $R_{102}$, and $R_{103}$ preferably has 6 to 20 total carbon atoms, and a phenyl group and a naphthyl group are examples. These groups can have a substituent group.

A heterocyclic group of $R_{101}$, $R_{102}$, and $R_{103}$ is a 3- to 15-membered ring having at least one element selected from nitrogen, oxygen, sulfur, selenium, and tellurium. Examples are a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tellurazole ring, a triazole ring, a benzotriazole ring, a tetrazole ring, an oxadiazole ring, and a thiadiazole ring. These groups can have a substituent.

Examples of the substituent groups of $R_{101}$, $R_{102}$, and $R_{103}$ are an alkyl group (e.g., methyl, ethyl, and hexyl), an alkoxy group (e.g., methoxy, ethoxy, and octyloxy), an aryl group (phenyl, naphthyl, and tolyl), a hydroxy group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butyryl, and varelyl), a sulfonyl group (e.g., methylsulfonyl and phenylsulfonyl), an acylamino group (e.g., acetylamino and benzamino), a sulfonylamino group (e.g., methanesulfonylamino and benzenesulfonylamino), an acyloxy group (e.g., acetoxy and benzoxy), a carboxyl group, a cyano group, a sulfo group, and an amino group.

E is preferably a divalent aliphatic group or a divalent aromatic group. Examples of the divalent aliphatic group of E are—$(CH_2)_n$—(n=1 to 12), —$CH_2$—CH═CH—$CH_2$—,

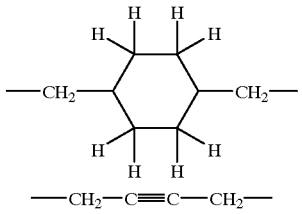

and a xylylene group. Examples of the divalent aromatic group of E are phenylene and naphthylene.

These substituent groups can be further substituted by the substituent group V described previously.

$M_{101}$ is preferably a metal ion or an organic cation. Examples of the metal ion are a lithium ion, a sodium ion, and a potassium ion. Examples of the organic cation are an ammonium ion (e.g., ammonium, tetramethylammonium, and tetrabutylammonium), a phosphonium ion (e.g., tetraphenylphosphonium), and a guanidine group.

Practical examples of a compound represented by formula (XX), (XXI), or (XXII) are presented below, but the present invention is not limited to these examples.

(XX-1)

$CH_3SO_2SNa$ (XX-2)

$C_2H_5SO_2SNa$ (XX-3)

$C_3H_7SO_2SK$ (XX-4)

$C_4H_9SO_2SLi$ (XX-5)

$C_6H_{13}SO_2SNa$ (XX-6)

$C_8H_{17}SO_2SNa$ (XX-7)

$CH_3(CH_2)_3CH(C_2H_5)CH_2SO_2S{\bullet}NH_4$ (XX-8)

$C_{10}H_{21}SO_2SNa$ (XX-9)

$C_{12}H_{25}SO_2SNa$ (XX-10)

$C_{16}H_{33}SO_2SNa$ (XX-11)

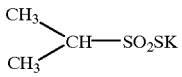

(XX-12)

t-$C_4H_9SO_2SNa$ (XX-13)

$CH_3OCH_2CH_2SO_2S{\bullet}Na$ (XX-14)

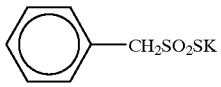

(XX-15)

$CH_2{=}CHCH_2SO_2SNa$

-continued
(XX-16)
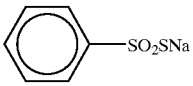
(XX-17)
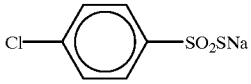
(XX-18)
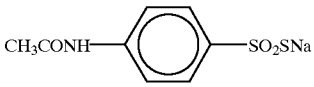
(XX-19)
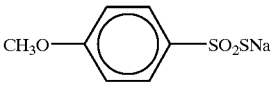
(XX-20)
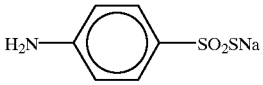
(XX-21)
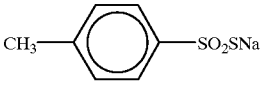
(XX-22)
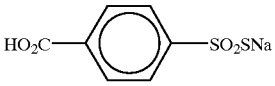
(XX-23)
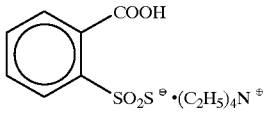
(XX-24)
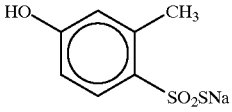
(XX-25)
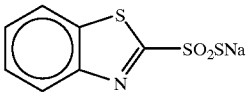
(XX-26)
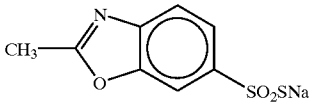
(XX-27)
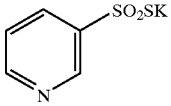
(XX-28)
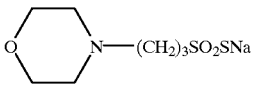
(XX-29)
$KSSO_2(CH_2)_2SO_2SNa$
-continued
(XX-30)
$NaSSO_2(CH_2)_4SO_2SNa$
(XX-31)
$NaSSO_2(CH_2)_4S(CH_2)_4SO_2SNa$
(XX-32)
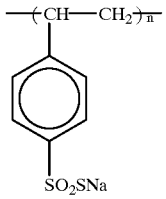
(XX-33)
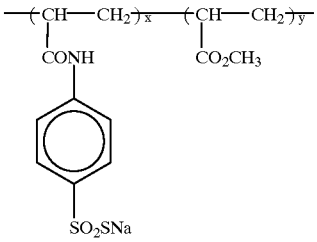
x:y=1/1 (molar ratio)
(XXI-1)
$C_2H_5SO_2S—CH_3$
(XXI-2)
$C_8H_{17}SO_2SCH_2CH_3$
(XXI-3)
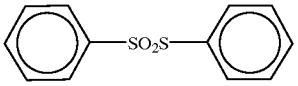
(XXI-4)
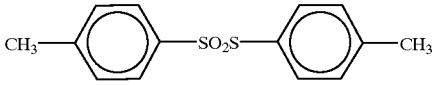
(XXI-5)
$C_2H_5SO_2SCH_2CH_2CN$
(XXI-6)
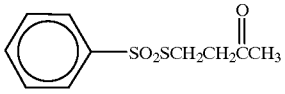
(XXI-7)
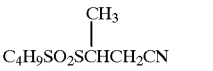
(XXI-8)
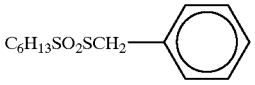
(XXI-9)
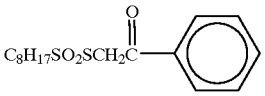

-continued
(XXI-10)
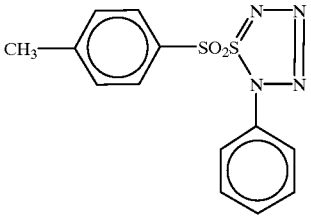
(XXI-11)
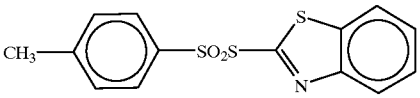
(XXI-12)
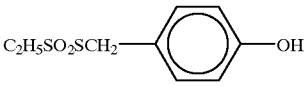
(XXI-13)
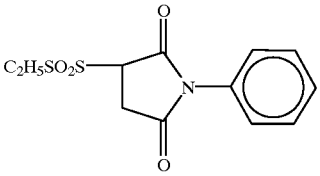
(XXI-14)
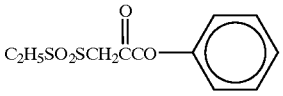
(XXI-15)
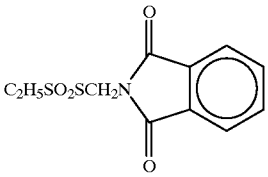
(XXI-16)
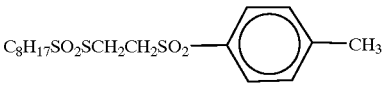
(XXI-17)
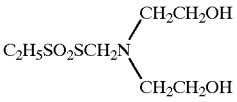
(XXI-18)
$C_2H_5SO_2SCH_2CH_2CH_2CH_2OH$
(XXI-19)
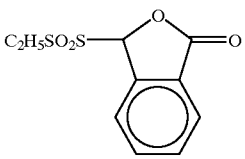
-continued
(XXI-20)
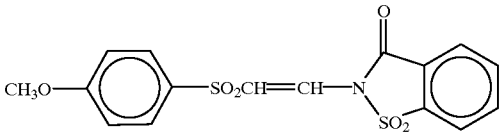
(XXI-21)
$CH_3SSO_2(CH_2)_4SO_2SCH_3$
(XXI-22)
$CH_3SSO_2(CH_2)_2SO_2SCH_3$
(XXI-23)
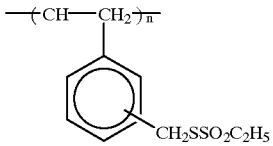
(XXI-24)
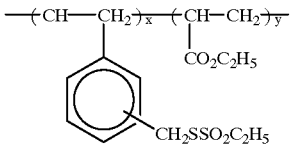
x:y=2/1 (Molar ratio)
(XXI-25)
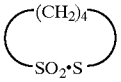
(XXII-1)
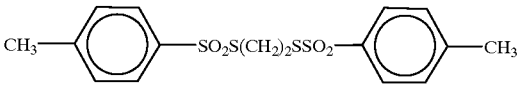
(XXII-2)
$C_2H_5SO_2SCH_2CH_2SO_2CH_2CH_2SSO_2C_2H_5$
(XXII-3)
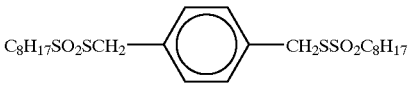
(XXII-4)
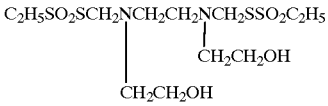
(XXII-5)
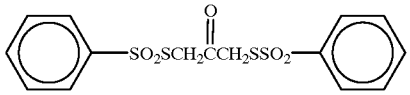
(XXII-6)
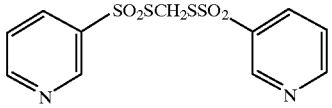
(XXII-7)
$C_2H_5SO_2SSSO_2C_2H_5$
(XXII-8)
$(n)C_3H_7SO_2SSSO_2C_3H_7(n)$ -continued (XXII-9)

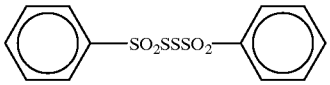

A compound of formula (XX) can be readily synthesized by methods described in JP-A-54-1019 and British Pat. No. 972,211.

The addition amount of a compound represented by formula (XX), (XXI), or (XXII) is preferably $10^{-7}$ to $10^{-1}$ mol, more preferably $10^{-6}$ to $10^{-2}$ mol, and most preferably $10^{-5}$ to $10^{-3}$ mol per mol of a silver halide in the light-sensitive silver halide emulsion.

To add a compound represented by formula (XX), (XXI), or (XXII) during the manufacturing process, methods normally used when additives are added to photographic emulsions can be applied. As an example, a water-soluble compound can be added in the form of an aqueous solution with an appropriate concentration. A water-insoluble compound or a compound which is sparingly soluble in water can be added in the form of a solution by dissolving the compound in an appropriate organic solvent which can be mixed in water, e.g., alcohols, glycols, ketones, esters, and amides, and which has no adverse effect on the photographic properties.

A compound represented by formula (XX), (XXI), or (XXII) can be added in any stage of the manufacture, i.e., during grain formation of a silver halide emulsion or before or after chemical sensitization of the emulsion. A compound is preferably added before or during reduction sensitization. A compound is particularly preferably added during grain growth.

Although a compound can be previously added to a reactor vessel, it is more preferable to add a compound at a proper timing during grain formation. It is also possible to add a compound represented by formula (XX), (XXI), or (XXII) to an aqueous solution of a water-soluble silver salt or a water-soluble alkali halide and form grains by using this aqueous solution. A method by which a solution of a compound represented by formula (XX), (XXI), or (XXII) is separately added several times or continuously added over a long time period with the progress of grain formation is also preferable.

Of compounds represented by formulas (XX), (XXI), and (XXII), the most preferable compound with respect to the present invention is a compound represented by formula (XX).

Silver halide emulsions are generally subjected to chemical sensitization before being used. As the chemical sensitization, chalcogen sensitization (sulfur sensitization, selenium sensitization, and tellurium sensitization), noble metal sensitization (e.g., gold sensitization), and reduction sensitization are performed singly or jointly. Performing chemical sensitization using the combination of the three sensitizers, a gold sensitizer, a sulfur sensitizer and a selenium sensitizer, is preferable.

In the sulfur sensitization, labile sulfur compounds are used as sensitizers. Labile sulfur compounds are described in, e.g., P. Grafkides, "Chimie et Physique Photographique (Paul Momtel, 1987, the 5th ed.) and Research Disclosure Vol. 307, No. 307105. Examples of sulfur sensitizers are thiosulfate (e.g., hypo), thioureas (e.g., diphenylthiourea, triethylthiourea, N-ethyl-N'-(4-methyl-2-thiazolyl)thiourea, and carboxymethyltrimethylthiourea), thioamides (e.g., thioacetamide), rhodanines (e.g., diethylrhodanine and 5-benzylidene-N-ethyl-rhodanine), phosphinesulfides (e.g., trimethylphosphinesulfide), thiohydantoins, 4-oxo-oxazolidine-2-thiones, dipolysulfides (e.g., dimorpholinedisulfide, cystine, and hexathiocane-thione), a mercapto compound (e.g., cysteine), polythionate, and elementary sulfur. Active gelatin can also be used as a sulfur sensitizer.

In the selenium sensitization, labile selenium compounds are used as sensitizers. Labile selenium compounds are described in JP-B-43-13489, JP-B-44-15748, JP-A-4-25832, JP-A-4-109240, JP-A-4-271341, and JP-A-5-40324. Examples of selenium sensitizers are colloidal metal selenium, selenoureas (e.g., N,N-dimethylselenourea, trifluoromethylcarbonyltrimethylselenourea, and acetyltrimethylselenourea), selenoamides (e.g., selenoacetamide and N,N-diethylphenylselenoamide), phosphineselenides (e.g., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarboxylic acids, selenoesters, and diacylselenides. It is also possible to use relatively stable selenium compounds (described in JP-B-46-4553 and JP-B-52-34492), such as selenius acid, potassium selenocyanide, selenazoles, and selenides, as selenium sensitizers.

In the tellurium sensitization, labile tellurium compounds are used as sensitizers. Labile tellurium compounds are described in Canadian Pat. No. 800,958, British Pat. Nos. 1,295,462 and 1,396,696, JP-A-4-204640, JP-A-4-271341, JP-A-4-333043, and JP-A-5-303157. Examples of tellurium sensitizers are telluroureas (e.g., tetramethyltellurourea, N,N'-dimethylethylenetellurourea, and N,N'-diphenylethylenetellurourea), phosphinetellurides (e.g., butyl-diisopropylphosphinetelluride, tributylphosphinetelluride, tributoxyphosphinetelluride, and ethoxydiphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, and bis(ethoxycarbonyl) telluride), isotellurocyanates, telluroamides, tellurohydrazides, telluroesters (e.g., butylhexyltelluroester), telluroketones (e.g., telluroacetophenone), colloidal tellurium, (di)tellurides, and other tellurium compounds (potassium telluride and telluropentathionatesodium salt).

In the noble metal sensitization, salts of noble metals such as gold, platinum, palladium, and iridium are used as sensitizers. Noble metal salts are described in P. Grafkides, "Chimie et Physique Photographique (Paul Momtel, 1987, the 5th ed.) and Research Disclosure Vol. 307, NO. 307105. Gold sensitization is particularly preferable among others. As described previously, the present invention is particularly effective in a mode in which gold sensitization is performed.

"Photographic Science and Engineering", Vol. 1, 19322 (1975) and "Journal of Imaging Science" Vol. 3228 (1988) describe that gold can be removed from sensitization nuclei on emulsion grains by the use of a solution containing potassium prussiate (KCN). According to these descriptions, cyan ions liberate gold atoms or gold ions adsorbed on silver halide grains as cyan complexes and consequently interfere with gold sensitization. When the production of cyan is suppressed in accordance with the present invention, a satisfactory effect of gold sensitization can be obtained.

Examples of gold sensitizers are chloroauric acid, potassium chloroaurate, potassium aurithiocyanate, gold sulfide, and gold selenide. Gold compounds described in U.S. Pat. Nos. 2,642,361, 5,049,484, and 5,049,485 can also be used.

Light-sensitive materials of the present invention are not particularly restricted. Examples are a color negative film, a color positive film, a black-and-white light-sensitive material, a negative film for movies, and a positive film for movies. That is, at least one light-sensitive layer need only be formed on a support. A typical example is a silver halide photographic light-sensitive material having, on its support, at least one light-sensitive layer constituted by a plurality of silver halide emulsion layers which are sensitive to essentially the same color but have different sensitivities. In the case of a color light-sensitive material, this light-sensitive layer includes a unit light-sensitive layer which is sensitive to one of blue light, green light, and red light. In a multi-layered silver halide color photographic light-sensitive material, these unit light-sensitive layers are generally arranged in the order of red-, green-, and blue-sensitive layers from a support. However, according to the intended use, this arrangement order may be reversed, or light-sensitive layers sensitive to the same color can sandwich another light-sensitive layer sensitive to a different color. Non-light-sensitive layers can be formed between the silver halide light-sensitive layers and as the uppermost layer and the lowermost layer. These interlayers can contain, e.g., couplers, DIR compounds, and color mixing inhibitors (to be described later). As a plurality of silver halide emulsion layers constituting each unit light-sensitive layer, a two-layered structure of high- and low-speed emulsion layers can be preferably used such that the sensitivity is sequentially decreased toward a support as described in DE 1,121,470 or GB 923,045. Also, as described in JP-A-57-112751, JP-A-62-200350, JP-A-62-206541, and JP-A-62-206543, layers can be arranged such that a low-speed emulsion layer is formed apart from a support and a high-speed layer is formed close to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) with an interlayer effect, which is described in U.S. Pat. No. 4,663,271, U.S. Pat. No. 4,705,744, U.S. Pat. No. 4,707,436, JP-A-62-160448, and JP-A-63-89850 and different from the main light-sensitive layers BL, GL, and RL in spectral sensitivity distribution, is preferably formed adjacent to or close to the main light-sensitive layers.

A preferable silver halide used in the present invention is silver iodobromide, silver iodochloride, or silver iodochlorobromide containing about 30 mol % or less of silver iodide. A particularly preferable silver halide is silver iodobromide or silver iodochlorobromide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twinned crystal faces, or composite shapes thereof.

A silver halide can consist of fine grains having a grain size of about 0.2 $\mu$m or less or large grains having a projected area diameter of up to about 10 $\mu$m, and an emulsion may be either a polydisperse or monodisperse emulsion.

A silver halide photographic emulsion which can be used in the present invention can be prepared by methods described in, e.g., "I. Emulsion preparation and types," Research Disclosure (to be abbreviated as RD hereafter) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. No. 3,574,628 and U.S. Pat. No. 3,655,394 and GB 1,413,748 are also preferable.

Also, tabular grains having an aspect ratio of about 3 or more can be used in the present invention. Tabular grains can be easily prepared by methods described in, e.g., Gutoff, "Photographic Science and Engineering", Vol. 14, pp. 248 to 257 (1970); U.S. Pat. No. (hereinafter referred to as US) 4,434,226, U.S. Pat. No. 4,414,310, U.S. Pat. No. 4,433,048, U.S. Pat. No. 4,439,520, and GB 2,112,157.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or zinc oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior a grain, and an emulsion of another type which has latent images on the surface and in the interior of a grain. However, the emulsion must be a negative type emulsion. In this case, the internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

In the present invention, metal ions can be doped into the grains.

Examples of metal ions are metal ions in the fourth, fifth, and sixth periods of group 3, groups 7 to 13, and group 15 in the periodic table (e.g., metal ions described in JP-A-2-219051). In the present invention, metal ions in the fourth, fifth, and sixth periods of groups 7, 8, and 9 are preferable. Practical examples of these preferable metal ions are Co, Re, Rh, Ru, Os, and Ir. These metal ions are used in the form of a simple salt or a complex of a metal complex salt. As a simple salt, a halide (a chloride or a bromide), nitrate, sulfate, or perchlorate can be preferably used. As a metal complex, 6-, 5-, 4- or 2-coordination complex can be used. A complex can be either a mono-nuclear complex or a poly-nuclear complex. Examples of a ligand constituting a complex are $Cl^-$, $Br^-$, $NO_2^-$, $CN^-$, $SCN^-$, $SO_3^{2-}$, $SO_4^{2-}$, $C_2O_4^{2-}$, CO, $NH_3$, amines (e.g., EDTA), $C_5H_5$, $C_6H_6$, and $H_2O$. Any of these metal complexes is preferably used as a salt of a complex of potassium salt, sodium salt, ammonium salt, or cesium salt.

Silver halide grains can have dislocation lines inside the grains. A technique which controls introduction of dislocations into silver halide grains is described in JP-A-63-220238. According to this description, dislocations can be introduced by forming a specific iodide rich phase in tabular silver halide grains whose average grain diameter/grain thickness ratio aspect ratio is 2 or more and covering these grains with a phase whose iodide content is lower than that of the iodide rich phase. This introduction of dislocations effectively raises the sensitivity, improves the storage stability and the latent image stability, and reduces the pressure fog. In the invention described in JP-A-63-220238, dislocations are primarily introduced into the edges of tabular grains. Also, tabular grains in which dislocations are introduced into central portions are described in U.S. Pat. No. 5,238,796. Furthermore, JP-A-4-348337 has disclosed regular crystal grains having dislocations inside the grains. JP-A-4-348337 has disclosed that dislocations can be introduced by producing epitaxy of silver chloride or silver chlorobromide in regular crystal grains and performing physical ripening and/or halogen conversion for this epitaxy. By this introduction of dislocations, the effects of increasing the sensitivity and reducing the pressure fog can be obtained. It is more preferable to introduce dislocations by using silver iodide fine grains or silver iodobromide fine grains.

Dislocation lines in silver halide grains can be observed by a direct method performed at a low temperature using a transmission electron microscope, as described in, e.g., J. F. Hamilton, Phot. Sci. Eng., 11, 57, (1967) or T. Shiozawa, J. Soc. Phot. Sci. Japan, 35, 213, (1972). That is, silver halide grains are carefully extracted from an emulsion so as not to produce a pressure capable of forming dislocations in the grains, and are placed on a mesh for electron microscopic observation. The sample is observed by a transmission method while being cooled to prevent damages (e.g., print out) caused by electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). Photographs of grains obtained by this method show the positions and the number of dislocation lines in each grain viewed in a direction perpendicular to the major faces.

The present invention is particularly effective when 50% or more of the number of silver halide grains have ten or more dislocation lines per grain.

A silver halide emulsion is normally subjected to physical ripening, chemical ripening, and spectral sensitization steps before it is used. Additives for use in these steps are described in RD Nos. 17643, 18716, and 307105, and they are summarized in a table presented later.

In the light-sensitive material of the present invention, it is possible to simultaneously use, in a single layer, two or more types of emulsions different in at least one of the characteristics of a light-sensitive silver halide emulsion, i.e., the grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. Methods of preparing the internally fogged or surface-fogged silver halide grain are described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver iodobromide, and silver iodochlorobromide can be used. The grain size (equivalent circular diameter of the projected area of the grain) of these fogged silver halide grains is preferably 0.01 to 0.75 $\mu$m, and particularly preferably 0.05 to 0.6 $\mu$m. The grains can also be regular grains, and the emulsion can be a polydisperse emulsion. However, the emulsion is preferably a monodisperse emulsion (in which at least 95% of the weight or number of grains of silver halide grains have grain sizes within ±40% of an average grain size).

In the present invention, it is preferable to use a non-light-sensitive fine grain silver halide. The non-light-sensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent circle diameters of projected areas) of the fine grain silver halide is preferably 0.01 to 0.5 $\mu$m, and more preferably 0.02 to 0.2 $\mu$m.

The fine grain silver halide can be prepared following the same procedures as for a common light-sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be added to this fine grain silver halide grain-containing layer.

The silver coating amount of the light-sensitive material of the present invention is preferably 10.0 g/m$^2$ or less, more preferably 6.0 g/m$^2$ or less, and most preferably 4.5 g/m$^2$ or less.

Photographic additives usable in the present invention are also described in RD, and the corresponding portions are summarized in the following table.

TABLE 1

| Additives | RD17643 (December, 1978) | RD18716 (November, 1979) | RD307105 (November, 1989) |
|---|---|---|---|
| 1. Chemical sensitizers | p. 23 | p. 648, right column | p. 866 |
| 2. Sensitivity increasing agents | | p. 648, right column | |
| 3. Spectral sensitizers, super sensitizers | pp. 23–24 | p. 648, right column - p. 649, right column | pp. 866–868 |
| 4. Brighteners | p. 24 | p. 647, right column | p. 868 |
| 5. Antifoggants, stabilizers | pp. 24–25 | p. 649, right column | pp. 868–870 |
| 6. Light absorbents, filter dyes, ultraviolet absorbents | pp. 25–26 | p. 649, right column - p. 650, left column | p. 873 |
| 7. Stain preventing agents | p. 25, right column | p. 650, left column - right column | p. 872 |
| 8. Dye image stabilizers | p. 25 | p. 650, left column | p. 872 |
| 9. Hardening agents | p. 26 | p. 651, left column | pp. 874–875 |
| 10. Binders | p. 26 | p. 651, left column | pp. 873–874 |
| 11. Plasticizers, lubricants | p. 27 | p. 650, right column | p. 876 |
| 12. Coating aids, surfactants | pp. 26–27 | p. 650, right column | pp. 875–876 |
| 13. Antistatic agents | p. 27 | p. 650 right column | pp. 876–877 |
| 14. Matting agents | | | pp. 878–879 |

Various dye forming couplers can be used in the light-sensitive material of the present invention, and the following couplers are particularly preferable.

Yellow couplers; couplers represented by formulas (I) and (II) in EP 502,424A; couplers represented by formulas (1) and (2) in EP 513,496A (particularly Y-28 on page 18); a coupler represented by formula (I) in claim 1 of EP 568,037A; a coupler represented by formula (I) in column 1, lines 45 to 55, in U.S. Pat. No. 5,066,576; a coupler represented by formula (I) in paragraph 0008 of JP-A-4-274425; couplers described in claim 1 on page 40 in EP 498,381A1 (particularly D-35 on page 18); couplers represented by formula (Y) on page 4 in EP 447,969A1 (particularly Y-1 (page 17) and Y-54 (page 41)); and couplers represented by formulas (II) to (IV) in column 7, lines 36 to 58, in U.S. Pat. No. 4,476,219 (particularly II-17, II-19 (column 17), and II-24 (column 19)).

Magenta couplers; JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP 456,257; M-4 and M-6 (page 26), and M-7 (page 27) in EP 486,965; M-45 (page 19) in EP 571,959A; (M-1) (page 6) in JP-A-5-204106; and M-22 in paragraph 0237 of JP-A-4-362631.

Cyan couplers; CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385.

Polymer couplers; P-1 and P-5 (page 11) in JP-A-2-44345.

Couplers for forming a colored dye with a proper diffusibility are preferably those described in U.S. Pat. No. 4,366,237, GB 2,125,570, EP 96,873B, and DE 3,234,533.

Couplers for correcting unnecessary absorption of a colored dye are preferably yellow colored cyan couplers represented by formulas (CI), (CII), (CIII), and (CIV) described on page 5 in EP 456,257A1 (particularly YC-86 on page 84); yellow colored magenta couplers ExM-7 (page 202), EX-1 (page 249), and EX-7 (page 251) in EP 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO92/11575 (particularly compound examples on pages 36 to 45).

Examples of a compound (including a coupler) which reacts with a developing agent oxidation product and releases a photographically useful compound residue are as follows. Development inhibitor release compounds: compounds represented by formulas (I), (II), (III), and (IV) on page 11 of EP 378,236A1 (particularly T-101 (page 30), T-104 (page 31), T-113 (page 36), T-131 (page 45), T-144 (page 51), and T-158 (page 58)), a compound represented by formula (I) on page 7 of EP 436,938A2 (particularly D-49 (page 51)), a compound represented by formula (1) in EP 568,037A (particularly (23) (page 11)), and compounds represented by formulas (I), (II), and (III) on pages 5 and 6 of EP 440,195A2 (particularly I-(1) on page 29); bleaching accelerator release compounds: compounds represented by formulas (I) and (I') on page 5 of EP 310,125A2 (particularly (60) and (61) on page 61), and compounds represented by formula (I) in claim 1 of JP-A-6-59411 (particularly (7) (page 7)); ligand release compounds: compounds represented by LIG-X described in claim 1 of U.S. Pat. No. 4,555,478 (particularly compounds in column 12, lines 21 to 41); leuco dye release compounds: compounds 1 to 6 in columns 3 to 8 of U.S. Pat. No. 4,749,641; fluorescent dye release compounds: compounds represented by COUP-DYE in claim 1 of U.S. Pat. No. 4,774,181 (particularly compounds 1 to 11 in columns 7 to 10); development accelerator or fogging agent release compounds: compounds represented by formulas (1), (2), and (3) in column 3 of U.S. Pat. No. 4,656,123 (particularly (I-22) in column 25), and ExZK-2 on page 75, lines 36 to 38, in EP 450,637A2; compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidation product scavengers: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)); stain inhibitors: formulas (I) to (III) on page 4, lines 30 to 33, particularly I-47, I-72, III-1, and III-27 (pages 24 to 48) in EP 298321A; brown inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP 298321A, II-1 to III-23, particularly III-10, in columns 25 to 38 of U.S. Pat. No. 5,122,444, I-1 to III-4, particularly II-2, on pages 8 to 12 in EP 471347A, and A-1 to A-48, particularly A-39 and A-42, in columns 32 to 40 of U.S. Pat. No. 5,139,931; materials which reduce the use amount of a color enhancer or a color amalgamation inhibitor: I-1 to II-15, particularly I-46, on pages 5 to 24 in EP 411324A; formalin scavengers: SCV-1 to SCV-28, particularly SCV-8, on pages 24 to 29 in EP 477932A; film hardeners: H-1, H-4, H-6, H-8, and H-14 on page 17 in JP-A-1-214845, compounds (H-1 to H-54) represented by formulas (VII) to (XII) in columns 13 to 23 of U.S. Pat. No. 4,618,573, compounds (H-1 to H-76), particularly H-14, represented by formula (6) on page 8, lower right column, in JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7, of U.S. Pat. No. 5,019,492; antiseptic agents and mildewproofing agents: I-1 to III-43, particularly II-1, II-9, II-10, II-18, and III-25, in columns 3 to 15 of U.S. Pat. No. 4,923,790; stabilizers and antifoggants: I-1 to (14), particularly I-1, I-60, (2), and (13), in columns 6 to 16 of U.S. Pat. No. 4,923,793, and compounds 1 to 65, particularly compound 36, in columns 25 to 32 of U.S. Pat. No. 4,952,483; chemical sensitizers: triphenylphosphine, selenide, and compound 50 in JP-A-5-40324; dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450, F-I-1 to F-II-43, particularly F-I-11 and F-II-8, on pages 33 to 55 in EP 445627A, III-1 to III-36, particularly III-1 and III-3, on pages 17 to 28 in EP 457153A, fine crystal dispersions of Dye-1 to Dye-124 on pages 8 to 26 in WO 88/04794, compounds 1 to 22, particularly compound 1, on pages 6 to 11 in EP 319999A, compounds D-1 to D-87 (pages 3 to 28) represented by formulas (1) to (3) in EP 519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) represented by formula (I) and compounds HBT-1 to HBT-10 (page 14) represented by formula (III) in EP 520938A, and compounds (1) to (31) (columns 2 to 9) represented by formula (1) in EP 521823A.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the total sum of film thicknesses of all hydrophilic colloidal layers on the side having emulsion layers is 28 μm or less, preferably 23 μm or less, more preferably 18 μm or less, and most preferably 16 μm or less. A film swell speed $T_{1/2}$ is preferably 30 sec. or less, and more preferably, 20 sec. or less. The film thickness means a film thickness measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, page 651, the left to right columns, and RD No. 307105, pp. 880 and 881.

A color developer used in development of the light-sensitive material of the present invention is preferably an aqueous alkaline solution primarily consisting of an aromatic primary amine-based color developing agent. Although an aminophenol-based compound is useful as this color developing agent, a p-phenylenediamine-based compound is preferably used. Representative examples of the p-phenylenediamine-based compound are compounds described in EP 556700A, page 28, lines 43 to 52. Two or more types of these compounds can be used together in accordance with the intended use.

In general, the color developer contains a pH buffering agent such as carbonate, borate, or phosphate of an alkali metal, and a development inhibitor or an antifoggant such as bromide, iodide, benzimidazoles, benzothiazoles, or a mercapto compound. If necessary, the color developer can also contain various preservatives such as hydroxylamine, diethylhydroxylamine, hydrazine sulfite, phenylsemicarbazide, triethanolamine, and catechol sulfonic acid; organic solvents such as ethyleneglycol and diethyleneglycol; development accelerators such as benzylalcohol, polyethyleneglycol, a quaternary ammonium salt, and amines; dye forming couplers, competing couplers, and auxiliary developing agents such as 1-phenyl-3-pyrazolidone; viscosity imparting agents; and various chelating agents such as aminopolycarboxylic acid, aminopolyphosphonic acid, alkylphosphonic acid, and phosphonocarboxylic acid. Representative examples of the chelating agents are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, a general approach is to first perform black-and-white development and then perform color development. As a black-and-white developer, well-known black-and-white developing agents, e.g., dihydroxybenzene such as hydroquinone, 3-pyrazolidone such as 1-phenyl-3-pyrazolidone, and aminophenyl such as N-methyl-p-aminophenol can be used singly or together. The pH of the color and black-and-white developers is generally 9 to 12. Although the quantity of replenisher of these developers depends on a color photographic light-sensitive material to be processed, it is generally 3 l or less per $m^2$ of a light-sensitive material. The quantity of replenisher can be decreased to be 500 ml or less by decreasing a bromide ion concentration in the replenisher. In order to decrease the quantity of replenisher, an area in which a processing solution contacts air is preferably decreased to prevent evaporation and oxidation of the replenisher upon contact with air.

An area in which a photographic processing solution contacts air in a processing tank can be represented by an aperture defined below:

aperture=[area ($cm^2$) in which processing solution contacts air] ÷ [volume ($cm^3$) of processing solution]

The above aperture is preferably 0.1 or less, and more preferably, 0.001 to 0.05. In order to reduce the aperture, a shielding member such as a floating cover can be provided on the liquid surface of the photographic processing solution in the processing tank. In addition, a method of using a movable cover described in JP-A-1-82033 or a slit developing method described in JP-A-63-216050 can be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching can be performed either simultaneously with fixing (bleach-fixing) or independently of it. In addition, in order to increase a processing speed, bleach-fixing can be performed after bleaching. Also, it is possible to perform processing in a bleach-fixing bath having two continuous tanks, perform fixing before bleach-fixing, or perform bleaching after bleach-fixing, in accordance with the intended use. Examples of the bleaching agent are a compound of a multivalent metal such as iron(III), peroxides (in particular, soda persulfate is suitable to color negative films for movies), quinones, and a nitro compound. Representative examples of the bleaching agent are an organic complex salt of iron(III), e.g., a complex salt of aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Practical examples of useful bleaching accelerators are described in the following specifications: compounds having a mercapto group or a disulfide group described in, e.g., U.S. Pat. No. 3,893,858, West German Pat. Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-18426, and Research Disclosure No. 17129 (July, 1978); a thiazolidine derivative described in JP-A-51-140129; thiourea derivatives described in JP-B-45-8506, JP-A-52-20832, JP-A-53-32735, and U.S. Pat. No. 3,706,561, and iodide salts described in West German Pat. No. 1,127,715 and JP-A-58-16235; polyoxyethylene compounds described in West German Pat. Nos. 966,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and bromide ion. Of these compounds, a compound having a mercapto group or a disulfide group is preferable since the compound has a large accelerating effect. In particular, compounds described in U.S. Pat. No. 3,893,858, West German Pat. No. 1,290,812, and JP-A-53-95630 are preferable. A compound described in U.S. Pat. No. 4,552,884 is also preferable. These bleaching accelerators can be added in the light-sensitive material. These bleaching accelerators are useful especially in bleach-fixing of a photographic color light-sensitive material.

In addition to the above compounds, the bleaching solution or the bleach-fixing solution preferably contains an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent used in the fixing solution and the bleach-fixing solution are thiosulfate, thiocyanate, a thioether-based compound, thioureas, and a large amount of iodide. Of these compounds, thiosulfate is generally used, and especially ammonium thiosulfate can be used in the widest range of applications. In addition, a combination of thiosulfate and a thiocyanate, a thioether-based compound, or thiourea is preferably used. As a preservative of the bleach-fixing solution, sulfite, bisulfite, a carbonyl bisulfite adduct, or a sulfinic acid compound described in European Pat. No. 294,769A is preferable. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible provided that no desilvering defect occurs. The time is preferably 1 to 3 min, and more preferably 1 to 2 min. The processing temperature is 25° C. to 50° C., preferably 35° C. to 45° C. Within the preferable temperature range, the desilvering speed is increased, and the generation of stains after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, and a method of increasing the stirring effect using rotating means described in JP-A-62-183461. Other examples are a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is considered that the improvement in stirring increases the speed of supply of the bleaching agent and the fixing agent into the emulsion film to lead to an increase in the desilvering speed. The above stirring improving means is more effective when the bleaching accelerator is used, i.e., significantly increases the accelerating speed or eliminates fixing interference caused by the bleaching accelerator.

An automatic processor for processing the light-sensitive material of the present invention preferably has a light-sensitive material conveyor means described in JP-A-60-191257, JP-A-60-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect is particularly effective to shorten the processing time in each processing step and reduce the processing solution replenishing amount.

The photographic light-sensitive material of the present invention is normally subjected to washing and/or stabilizing steps after desilvering. An amount of water used in the washing step can be determined over a broad range in accordance with the properties (e.g., a property determined by use of a coupler) of the light-sensitive material, the intended use of the material, the temperature of the water, the number of water tanks (the number of stages), a replenishing scheme such as a counter or forward flow, and other various conditions. The relationship between the amount of water and the number of water tanks in a multi-stage counter-flow scheme can be obtained by a method described in "Journal of the Society of Motion Picture and Television Engineering", Vol. 64, PP. 248–253 (May, 1955). According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, it is possible to use a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 sec to 10 min at a temperature of 15° C. to 45° C., preferably 30 sec to 5 min at 25° C. to 40° C. The light-sensitive material of the present invention can be processed directly by a stabilizing solution in place of washing. All known methods described in JP-A-57-8543, JP-A-58-14834, and JP-A-60-220345 can be used in such stabilizing processing.

Stabilizing is sometimes performed subsequently to washing. One example is a stabilizing bath containing a dye stabilizing agent and a surface-active agent to be used as a final bath of the photographic color light-sensitive material. Examples of the dye stabilizing agent are aldehydes such as formalin and glutaraldehyde, an N-methylol compound, hexamethylenetetramine, and an aldehyde sulfurous acid adduct. Various chelating agents or antifungal agents can be added to the stabilizing bath.

An overflow solution produced upon washing and/or replenishment of the stabilizing solution can be reused in another step such as a desilvering step.

In the processing using an automatic processor or the like, if each processing solution described above is condensed by evaporation, water is preferably added to correct condensation.

The silver halide color photographic light-sensitive material of the present invention can contain a color developing agent in order to simplify the processing and increase the processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure Nos. 14,850 and 15,159, an aldol compound described in Research Disclosure No. 13,924, a metal salt complex described in U.S. Pat. No. 3,719,492, and a urethane-based compound described in JP-A-53-135628.

The silver halide color photographic light-sensitive material of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., the processing can be accelerated at a higher temperature to shorten the processing time, or the image quality or stability of a processing solution can be improved at a lower temperature.

The present invention can be preferably applied to a silver halide photographic light-sensitive material having a transparent magnetic recording layer. A silver halide light-sensitive material carrying magnetic recording used in the present invention can be manufactured by annealing a polyester thin-layer support described in detail in JP-A-6-35118 or JP-A-6-17528 or JIII Journal of Technical Disclosure No. 94-6023, e.g., a polyethylene aromatic dicarboxylate polyester support, having a thickness of 50 to 300 μm, preferably 50 to 200 μm, more preferably 80 to 115 μm, and most preferably 85 to 105 μm, at 40° C. to a glass transition temperature for 1 to 1500 hr, performing a surface treatment such as ultraviolet irradiation described in JP-B-43-2603, JP-B-43-2604, or JP-B-45-3828, corona discharge described in JP-B-48-5043 or JP-A-51-131576, or glow discharge described in JP-B-35-7578 or JP-B-46-4348, performing undercoating described in U.S. Pat. No. 5,326,689, forming an underlayer described in U.S. Pat. No. 2,761,791 where necessary, and coating ferromagnetic grains described in JP-A-59-23505, JP-A-4-195726, or JP-A-6-59357.

Note that the magnetic layer described above can also have the shape of stripes described in JP-A-4-124642 or JP-A-4-124645.

In addition, the material is subjected to an antistatic treatment described in JP-A-4-62543 if necessary and finally coated with silver halide emulsions. As the silver halide emulsions, JP-A-4-166932, JP-A-3-41436, and JP-A-3-41437 are used.

It is preferable that the light-sensitive material thus formed be manufactured by a manufacture control method described in JP-B-4-86817 and the manufacturing data be recorded by a method described in JP-B-6-87146. After or before the data recording, the material is cut into a film narrower than a conventional 135 size, and two perforations are formed on each side of each small-format frame such that the frame matches a format frame smaller than a conventional frame.

The film thus manufactured is used after being packed into a cartridge package described in JP-A-4-157459, a cartridge shown in FIG. 9 of an embodiment in JP-A-5-210202, a film magazine described in U.S. Pat. No. 4,221,479, or a cartridge described in U.S. Pat. No. 4,834,306, U.S. Pat. No. 4,834,366, U.S. Pat. No. 5,226,613 or U.S. Pat. No. 4,846,418.

The film cartridge or the film magazine herein used is preferably a cartridge or a magazine whose tongue can be housed such as described in U.S. Pat. No. 4,848,693 or U.S. Pat. No. 5,317,355 from the viewpoint of light shielding properties.

Furthermore, it is preferable to use a cartridge having a lock mechanism described in U.S. Pat. No. 5,296,886, a cartridge described in U.S. Pat. No. 5,347,334 which displays the use state, or a cartridge having a double exposure preventing function.

It is also possible to use a cartridge described in JP-A-6-85128 by which a film is easily loaded only by inserting the film into the cartridge.

The film cartridge thus formed can be purposefully used in photography, development, and various pleasures of photography by using cameras, developing machines, and laboratory apparatuses to be described next.

For example, the function of the film cartridge (magazine) can be well achieved by using easy-loading cameras described in JP-A-6-886 and JP-A-6-99908, automatic winding cameras described in JP-A-6-57398 and JP-A-6-101135, a camera described in JP-A-6-205690 by which a film can be unloaded and replaced with another film during photography, cameras described in JP-A-5-293138 and JP-A-5-283382 by which photographic information such as panorama photography, Highvision photography, and regular photography (capable of magnetic recording by which the print aspect ratio can be selected) can be magnetically recorded on a film, a camera having a double exposure preventing function described in JP-A-6-101194, and a camera having a function of displaying the use state of, e.g., a film described in JP-A-5-150577.

A film thus photographed is processed by an automatic processor described in JP-A-6-222514 or JP-A-6-222545. Alternatively, a method of using magnetic recording on a film described in JP-A-6-95265 or JP-A-4-123054 or an aspect ratio selecting function described in JP-A-5-19364 can be used before, during, or after the processing.

If the development is motion picture development, the film is spliced by a method described in JP-A-5-119461.

Also, attaching and detaching described in JP-A-6-148805 are performed during or after the development.

After the processing, the print information can be converted into prints by back-printing or front-printing for color paper by using a method described in JP-A-2-184835, JP-A-4-18635, or JP-A-6-79968.

Furthermore, the film can be returned to the customer together with an index print and a return cartridge described in JP-A-5-11353 or JP-A-5-232594.

EXAMPLES

The present invention will be described in more detail below by way of its examples. However, the present invention is of course not limited to these examples.

Example 1

(1) Preparation of emulsion (Em-101)

While an aqueous solution prepared by dissolving 6.5 g of potassium bromide and 28 g of inert gelatin with an average molecular weight of 15,000 in 3.5 l of distilled water was well stirred, a 14% aqueous solution of potassium bromide and a 20% aqueous solution of silver nitrate were added to the solution by a double-jet method at fixed flow rates over 1 min at 50° C. and a pBr of 1.0 (in this addition 2.4% of the total silver amount were consumed).

An aqueous gelatin solution (15%, 340 cc) was added, and the resultant solution was stirred at 55° C. Thereafter, a 20% aqueous solution of silver nitrate was added at a fixed flow rate until the pBr reached 1.4 (in this addition 5.0% of the total silver amount were consumed). $1.3\times10^{-5}$ mol of thiourea dioxide was added per mol of silver. In addition, a 20% aqueous solution of potassium bromide ($KBr_{1-x}I_x$: x=0.04) and a 33% aqueous solution of silver nitrate were added by a double-jet method over 43 min (in this addition 50% of the total silver amount were consumed). After $2.8\times10^{-4}$ mol of sodium ethylthiosulfonate was added per mol of silver, an aqueous solution containing 8.3 g of potassium iodide was added, 14.5 ml of an aqueous solution of 0.001/wt % $K_3IrCl_6$ were added, and a 20% potassium bromide solution and a 33% aqueous solution of silver nitrate were added by a double-jet method over 39 min (in this addition 42.6% of the total silver amount were consumed). The amount of silver nitrate used in this emulsion was 425 g. The emulsion was then desalted by a conventional flocculation method, and the pAg and the pH were adjusted to 8.2 and 5.8, respectively, at 40° C. The prepared emulsion was a tabular silver iodobromide emulsion (Em-1) having an average aspect ratio of 6.7, a variation coefficient of the equivalent-circular diameter of 18%, and an equivalent-sphere diameter of 0.85 $\mu$m. It was found by observation performed at a liquid $N_2$ temperature by using a 200-kV transmission electron microscope that, on the average, 50 or more dislocation lines were present per grain in a portion near the periphery of a tabular grain.

$1\times10^{-3}$ mol/mol Ag of a compound H-4 was added to the emulsion (Em-1) thus prepared, and a sensitizing dye ExS-1 ($2.0\times10^{-4}$ mol/mol Ag), a sensitizing dye ExS-3 ($2.7\times10^{-4}$ mol/mol Ag), and a sensitizing dye ExS-2 ($2.0\times10^{-5}$ mol/mol Ag) were added. Thereafter, gold-selenium-sulfur sensitization was optimally performed by using sodium sulfate, chloroauric acid, N,N-dimethylselenourea, and potassium thiocyanate. The resultant emulsion was Em-101.

(2) Preparation of Em-102

The compound H-4 in Em-101 was changed in an equimolar amount to a compound S-19.

(3) Preparation of Em-103

The sensitizing dyes ExS-1, ExS-3, and ExS-2 in Em-102 were changed in an equimolar amount to sensitizing dyes (20), (27), and (30), respectively.

(4) Preparation of emulsions (Em-104 to Em-107)

The compound S-19 in Em-103 was changed in an equimolar amount to compounds S-5, S-1, S-14, and S-4, respectively.

(5) Preparation of Em-108 and Em-109

The compound S-19 in Em-102 was changed in an equimolar amount to the compounds S-4 and S-14, respectively.

(6) Preparation of Em-110 to Em-112

Thiourea dioxide added during the grain formation of Em-107, Em-108, and Em-102, respectively was not added.

(7) Preparation of Em-113

The compound H-4 was further added in an amount of $1\times10^{-3}$ mol/mol Ag in addition to the compound S-4 in Em-107.

(8) Preparation of Em-114

The sensitizing dye (20) in Em-107 was changed in an equimolar amount to the sensitizing dye (21).

(9) Preparation of Em-115

The sensitizing dye (27) in Em-107 was changed in an equimolar amount to a sensitizing dye (25).

(10) Preparation of Em-116 to Em-119

The compound S-4 added in Em-110, Em-111, Em-107, and Em-108, respectively was not added.

(11) Preparation of emulsions Em-120 to Em-122

A compound of formula (III) in Em-113 was changed from H-4 to an equimolar amount of H-2, H-3, and H-9, respectively.

Undercoated cellulose triacetate film supports were coated with a plurality of layers having the compositions presented below, thereby forming samples 101 to 122 of multilayered color light-sensitive materials. The emulsions (Em-101 to Em-122) described above were used in the fifth layer.

(Compositions of light-sensitive layers)

The main materials used in the individual layers were classified as follows.

| | | | |
|---|---|---|---|
| ExC: | Cyan coupler | UV: | Ultraviolet absorbent |
| ExM: | Magenta coupler | HBS: | High-boiling organic solvent |
| ExY: | Yellow coupler | H: | Gelatin hardener |
| ExS: | Sensitizing dye | | |

The number corresponding to each component indicates the coating amount in units of g/m$^2$. The coating amount of a silver halide is represented by the amount of silver. The coating amount of each sensitizing dye is represented in units of mols per mol of a silver halide in the same layer.

1st layer (Antihalation layer)

| | | |
|---|---|---|
| 1st layer (Antihalation layer) | | |
| Black colloidal silver | silver | 0.09 |
| Gelatin | | 1.60 |
| ExM-1 | | 0.12 |
| ExF-1 | | $2.0 \times 10^{-3}$ |
| Solid disperse dye ExF-2 | | 0.030 |
| Solid disperse dye ExF-3 | | 0.040 |
| HBS-1 | | 0.15 |
| HBS-2 | | 0.02 |
| 2nd layer (Interlayer) | | |
| Silver iodobromide emulsion M | silver | 0.065 |
| ExC-2 | | 0.04 |
| Polyethylacrylate latex | | 0.20 |
| Gelatin | | 1.04 |
| 3rd layer (Low-speed red-sensitive emulsion layer) | | |
| Silver iodobromide emulsion A | silver | 0.25 |
| Siiver iodobromide emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.101 |
| Cpd-2 | | 0.025 |
| HBS-1 | | 0.10 |
| Gelatin | | 0.87 |
| 4th layer (Medium-speed red-sensitive emulsion layer) | | |
| Silver iodobromide emulsion C | silver | 0.68 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| 5th layer (High-speed red-sensitive emulsion layer) | | |
| Emulsion shown in Table 3 | silver | 1.44 |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| 6th layer (Interlayer) | | |
| Cpd-1 | | 0.090 |
| Solid disperse dye ExF-4 | | 0.030 |
| HBS-1 | | 0.050 |
| polyethylacrylate latex | | 0.15 |
| Gelatin | | 1.10 |
| 7th layer (Low-speed green-sensitive emulsion layer) | | |
| Silver iodobromide emulsion E | silver | 0.15 |
| Silver iodobromide emulsion F | silver | 0.10 |
| Silver iodobromide emulsion G | silver | 0.10 |
| ExS-4 | | $3.0 \times 10^{-4}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Silver iodobromide emulsion H | silver | 0.83 |
| ExS-4 | | $3.2 \times 10^{-4}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| 9th layer (High-speed green-sensitive emulsion layer) | | |
| Silver iodobromide emulsion I | silver | 1.22 |
| ExS-4 | | $8.8 \times 10^{-5}$ |
| ExS-5 | | $4.6 \times 10^{-5}$ |
| ExS-6 | | $3.4 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| 10th layer (Yellow filter layer) | | |
| Yellow colloidal silver | silver | 0.015 |
| Cpd-1 | | 0.16 |
| Solid disperse dye ExF-5 | | 0.060 |
| Solid disperse dye ExF-6 | | 0.060 |
| Oil-soluble dye ExF-7 | | 0.010 |
| HBS-1 | | 0.60 |
| Gelatin | | 0.60 |
| 11th layer (Low-speed blue-sensitive emulsion layer) | | |
| Silver iodobromide emulsion J | silver | 0.08 |

-continued

| | | |
|---|---|---|
| Silver iodobromide emulsion K | silver | 0.08 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| 12th layer (High-speed blue-sensitive emulsion layer) | | |
| Silver iodobromide emulsion L | silver | 1.05 |
| ExS-7 | | $4.3 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| 13th layer (1st protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| 14th (2nd protective layer) | | |
| Silver iodobromide emulsion M | silver | 0.10 |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.70 |

In addition to the above components, to improve the storage stability, processability, a resistance to pressure, antiseptic and mildewproofing properties, antistatic properties, and coating properties, W-1 to W-3, B-4 to B-6, F-1 to F-17, iron salt, lead salt, gold salt, platinum salt, palladium salt, iridium salt, and rhodium salt are properly contained in each layer.

Table 2 below shows the average AgI contents and the grain sizes of the emulsions A to C and E to M used in the formation of these samples.

In Table 2, (1) The emulsions A to C and E to L were subjected to reduction sensitization during grain preparation by using thiourea dioxide and thiosulfonic acid (XX-16) in accordance with the Example of JP-A-2-191938.

(2) The emulsions A to L were subjected to gold sensitization, sulfur sensitization, and selenium sensitization in the presence of the spectral sensitizing dyes described in the individual light-sensitive layers and sodium thiocyanate in accordance with the Example of JP-A-3-237450.

(3) The preparation of tabular grains was performed by using low-molecular weight gelatin in accordance with the Example of JP-A-1-158426.

(4) Dislocation lines as described in JP-A-3-237450 were observed in tabular grains when a high-voltage electron microscope was used.

(5) The emulsion L consisted of double structure grains containing an internally high iodide core described in JP-A-60-143331.

Preparation of dispersions of organic solid disperse dyes ExF-2 was dispersed by the following method.

That is, 21.7 ml of water, 3 ml of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-ml pocket mill, and 5.0 g of the dye ExF-2 and 500 ml of zirconium oxide beads (diameter 1 mm) were added to the mill. The contents were dispersed for 2 hr. This dispersion was done by using a BO type oscillating ball mill manufactured by Chuo Koki K. K. The dispersion was removed from the mill, and 8 g of a 12.5% aqueous solution of gelatin were added. The beads were removed from the resultant material by filtration, obtaining a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP 549,489A. The average grain size was found to be 0.06 μm.

Compounds used to prepare the samples are set forth below.

TABLE 2

| | Average AgI content (mol %) | Variation coefficient of inter-grain AgI content (%) | Average grain diameter, equivalent circular diameter (μm) | Variation coefficient of grain diameter (%) | Equivalent circular diameter of projected area (μm) | Diameter/Thickness |
|---|---|---|---|---|---|---|
| Emulsion A | 1.7 | 10 | 0.46 | 15 | 0.56 | 5.5 |
| B | 3.3 | 7 | 0.57 | 20 | 0.78 | 4.0 |
| C | 8.9 | 18 | 0.66 | 17 | 0.87 | 5.8 |
| E | 1.7 | 10 | 0.46 | 15 | 0.56 | 5.5 |
| F | 3.3 | 15 | 0.57 | 13 | 0.78 | 4.0 |
| G | 8.8 | 13 | 0.61 | 17 | 0.77 | 4.4 |
| H | 8.8 | 25 | 0.61 | 23 | 0.77 | 4.4 |
| I | 8.7 | 18 | 0.84 | 18 | 1.03 | 3.7 |
| J | 1.7 | 10 | 0.46 | 15 | 0.50 | 4.2 |
| K | 8.8 | 15 | 0.64 | 19 | 0.85 | 5.2 |
| L | 14.2 | 18 | 1.28 | 19 | 1.46 | 3.5 |
| M | 1.0 | — | 0.07 | 15 | — | 1 |

ExC-1
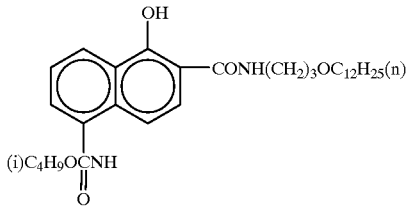
ExC-2
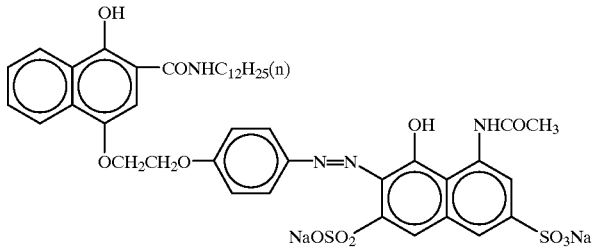
ExC-3
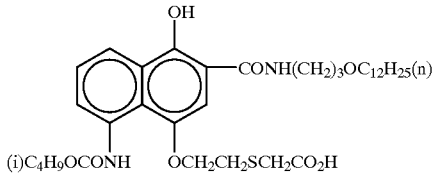
ExC-4
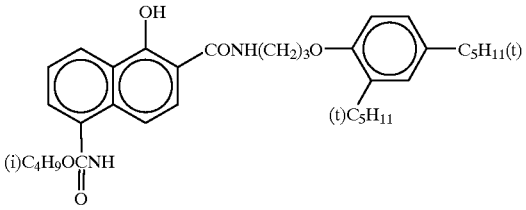
ExC-5
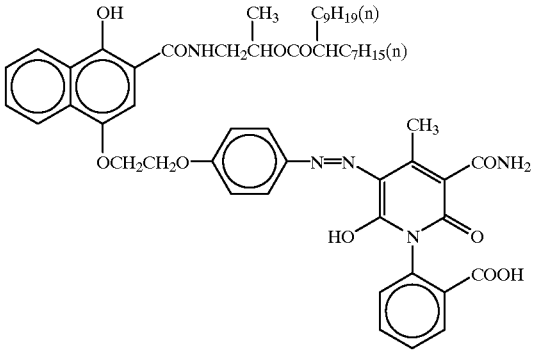
ExC-6
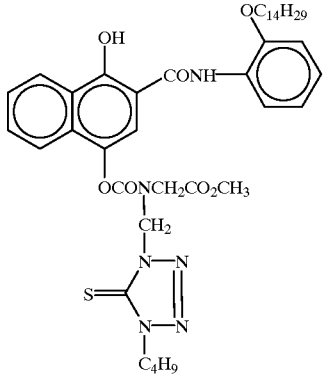
ExC-7
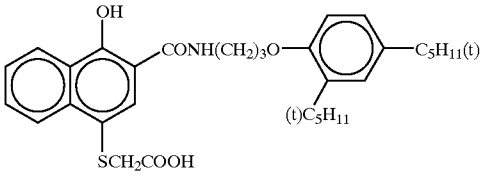
ExC-8
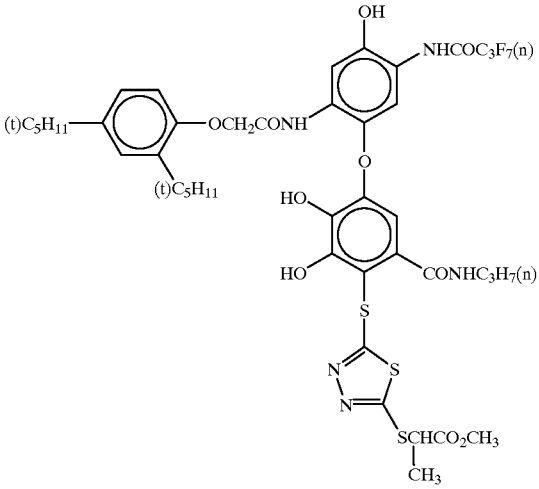

-continued
ExM-1
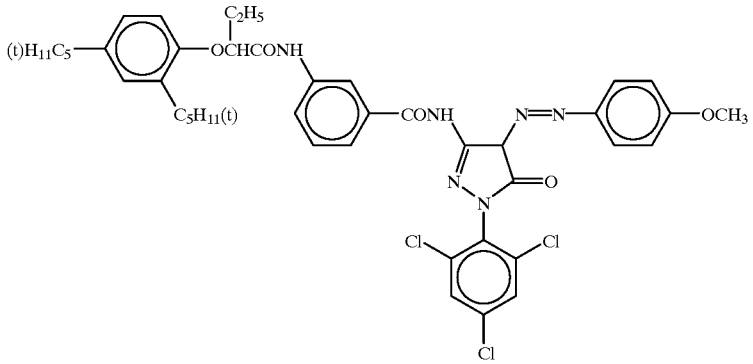
ExM-2
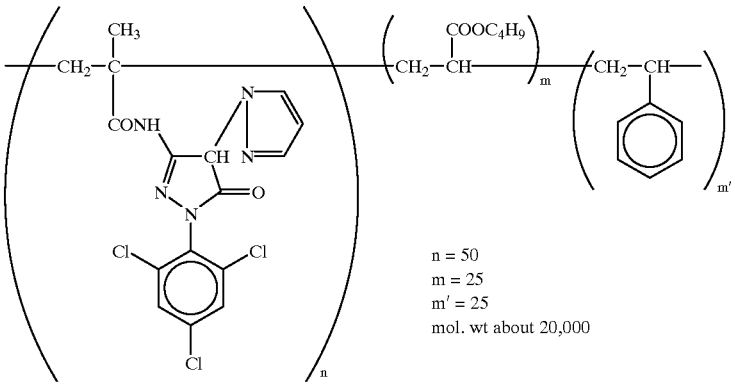
n = 50
m = 25
m′ = 25
mol. wt about 20,000
ExM-3
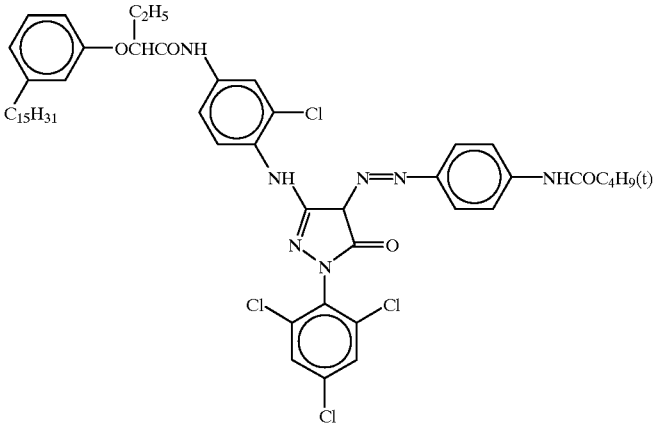
ExM-4
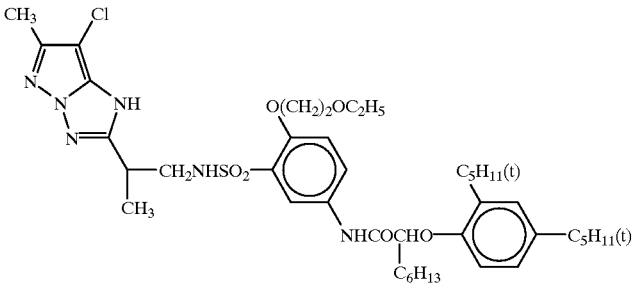

-continued
ExM-5
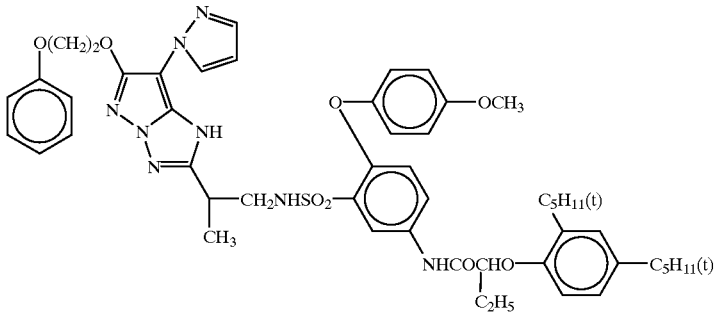
ExY-1
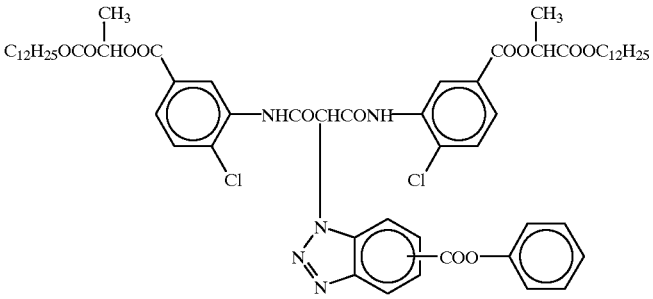
ExY-2
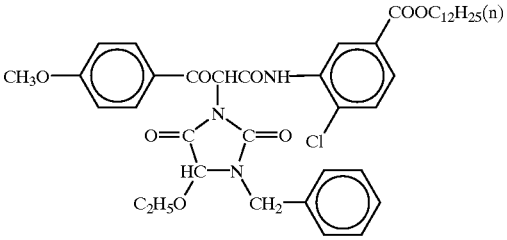
ExY-3
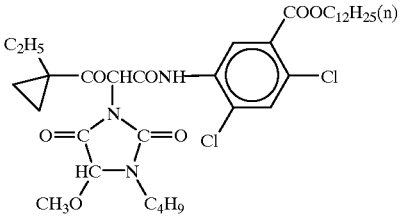
ExY-4
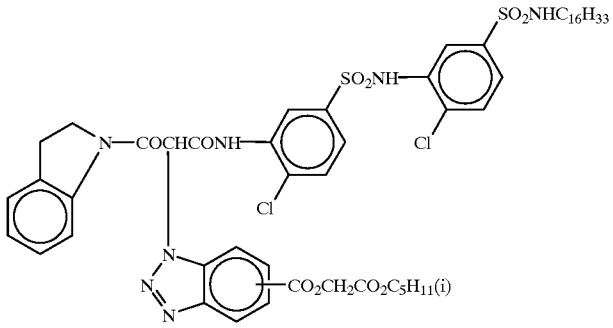
ExY-5
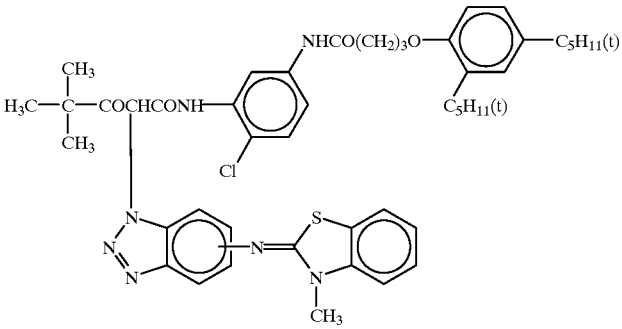

-continued
ExF-1
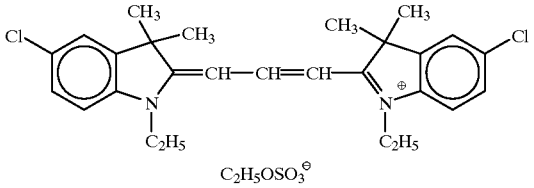
ExF-2
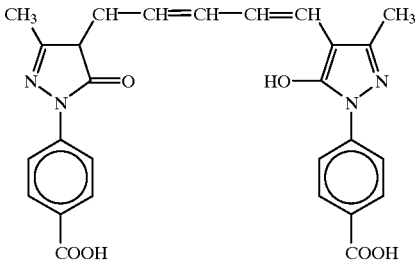
ExF-3
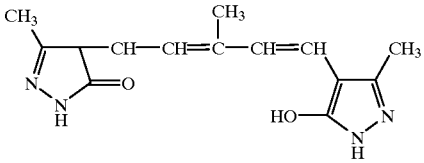
ExF-4
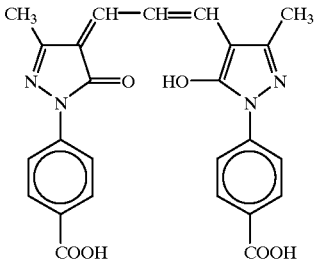
ExF-5
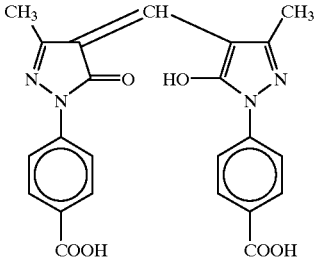
ExF-6
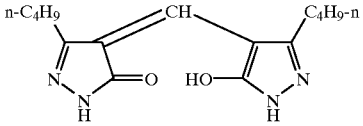
ExF-7
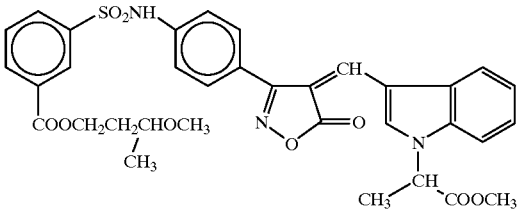
Cpd-1
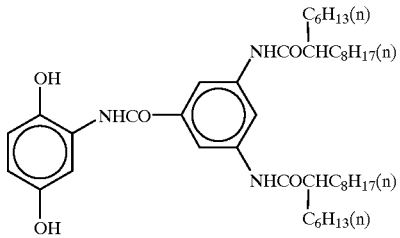
Cpd-2
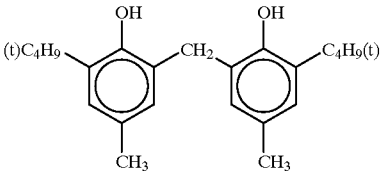
Cpd-3
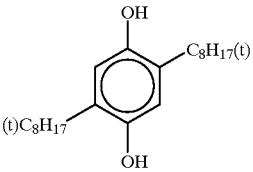
UV-1
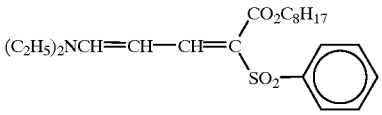
UV-2
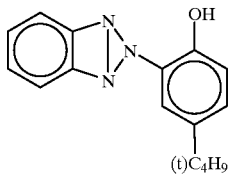

-continued
UV-3
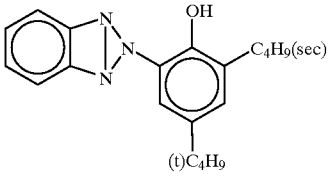
HBS-1
Tricresylphosphate
HBS-2
Di-n-butylphthalate
HBS-3
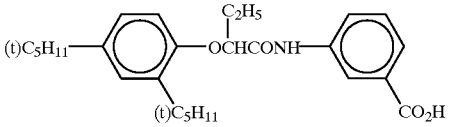
HBS-4
Tri(2-ethylhexyl)phosphate
ExS-1
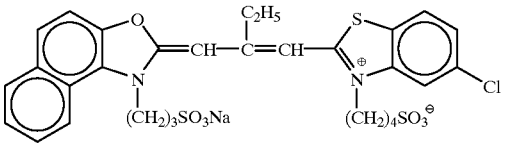
ExS-2
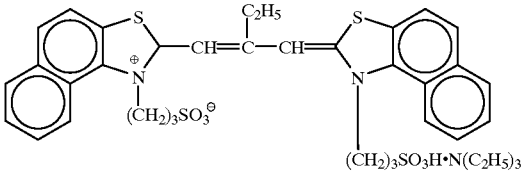
ExS-3
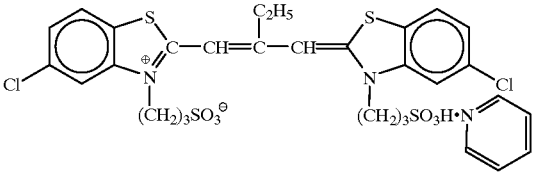
ExS-4
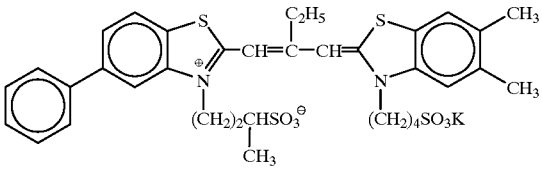
ExS-5
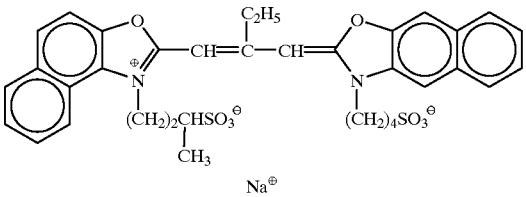
ExS-6
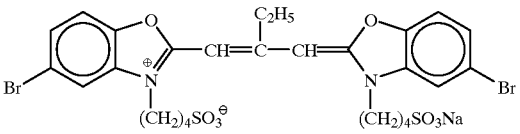
ExS-7
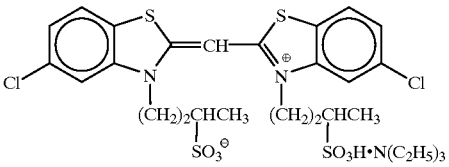
S-1
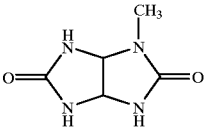
H-1
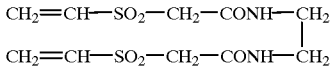
B-1
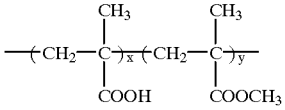
x/y = 10/90 (weight ratio)
Average Molecular Weight:
about 35,000
B-2
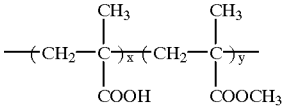
x/y = 40/60 (weight ratio)
Average Molecular Weight:
about 20,000

-continued
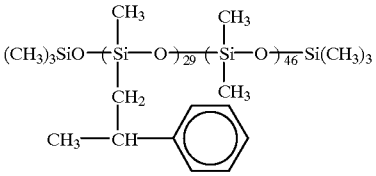
(molar ratio)
Average Molecular Weight:
about 8,000
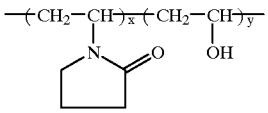
x/y = 70/30 (weight ratio)
Average Molecular Weight:
about 17,000
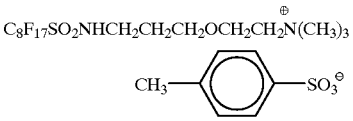
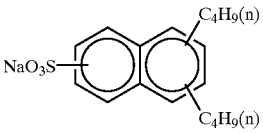
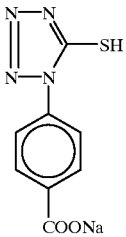
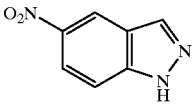
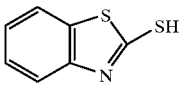
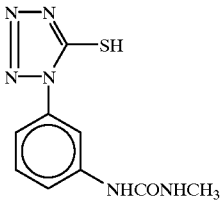
B-3
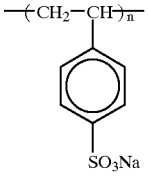
Average Molecular Weight:
about 750,000
B-4
B-5
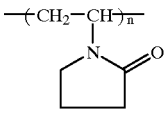
Average Molecular Weight:
about 10,000
B-6
W-1
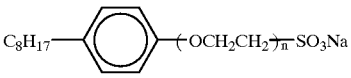
N = 2 to 4
W-2
W-3
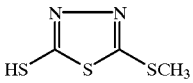
F-1
F-2
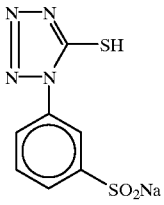
F-3
F-4
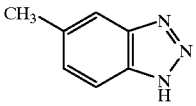
F-5
F-6
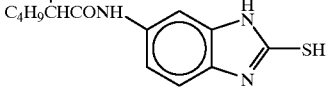
F-7
F-8
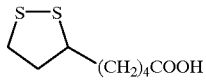
F-9

-continued

F-10

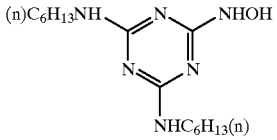

F-11

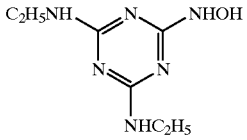

F-12

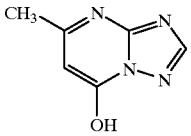

F-13

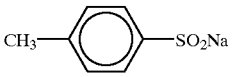

F-14

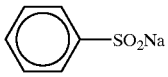

F-15

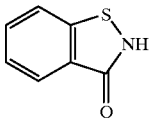

F-16

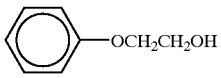

F-17

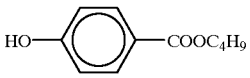

The samples 101 to 122 thus formed were given sensitometry exposure for 1/100 sec at a color temperature of 4800° K. through a continuous wedge. The resultant samples were subjected to the following color development.

The processing method is presented below.

Processing Method

| Step | Time | Temperature | Quantity of replenisher | Tank volume |
|---|---|---|---|---|
| Color development | 3 min. 15 sec. | 38° C. | 33 ml | 20 l |
| Bleaching | 6 min. 30 sec. | 38° C. | 25 ml | 40 l |
| Washing | 2 min. 10 sec. | 24° C. | 1200 ml | 20 l |
| Fixing | 4 min. 20 sec. | 38° C. | 25 ml | 30 l |
| Washing (1) | 1 min. 05 sec. | 24° C. | Counter flow piping from (2) to (1) | 10 l |
| Washing (2) | 1 min. 00 sec. | 24° C. | 1200 ml | 10 l |
| Washing (3) | 1 min. 05 sec. | 38° C. | 25 ml | 10 l |
| Drying | 4 min. 20 sec. | 55° C. | | |

A quantity of replenisher is represented by a value per 1 m of a 35-mm wide sample.

The compositions of the processing solutions will be described below.

| | Mother solution (g) | Replenisher (g) |
|---|---|---|
| (Color developer) | | |
| Diethylenetriamine-pentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxyethylamino]-2-methylaniline sulfate | 4.5 | 5.5 |
| Water to make | 1.0 l | 1.0 l |
| pH | 10.05 | 10.10 |
| (Bleaching solution) | | |
| Ferric Sodium ethylenediamine-tetraacetate trihydrate | 100.0 | 120.0 |
| Disodium ethylene-diaminetetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| (Fixing solution) | | |
| Disodium ethylene-diaminetetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 l | 1.0 l |
| pH | 6.7 | 6.6 |
| (Stabilizing solution) | | |
| Formalin (37%) | 2.0 ml | 3.0 ml |
| Polyoxyethylene-p-monononylphenylether (average polymerization degree = 10) | 0.3 | 0.45 |
| Disodium ethylene-diaminetetraacetate | 0.05 | 0.08 |
| Water to make | 1.0 l | 1.0 l |
| pH | 5.8–8.0 | 5.8–8.0 |

The densities of the processed samples were measured.

The sensitivity of each sample is indicated by a value of $100\times[\log(E_{101}/E_x)+1]$, wherein $E_x$ (x is 101 to 122) is an amount required for the optical densities of sample x to be higher by 0.2 than the fog value of the sample x. That is, the sensitivity of the sample 101 is 100, and the sensitivity of a sample having a double sensitivity (half exposure amount) of the sample 101 is 130.

The storage stability was evaluated as follows. That is, two sets of groups of samples 101 to 122 were prepared. Each sample of one group was exposed to light and developed as mentioned above. Each sample of the other group was stored at a temperature of 70° C. and a relative humidity of 60% for 24 hr and similarly exposed and developed. Thereafter, a change in the density from each unstored sample to each stored sample at the portion that gives fogging was evaluated.

The results thus obtained are summarized in Table 3 below.

TABLE 3

| Sample No. | Emulsion of 5th layer | Sensitizing dye of 5th layer | Compound of general formula (I) |
|---|---|---|---|
| 101 (Comparison) | Em-101 | ExS-1/ExS-3/ExS-2 | — |
| 102 (Comparison) | Em-102 | ExS-1/ExS-3/ExS-2 | S-19 |
| 103 (Invention) | Em-103 | (20)/(27)/(30) | S-19 |
| 104 (Invention) | Em-104 | (20)/(27)/(30) | S-5 |
| 105 (Invention) | Em-105 | (20)/(27)/(30) | S-1 |
| 106 (Invention) | Em-106 | (20)/(27)/(30) | S-14 |
| 107 (Invention) | Em-107 | (20)/(27)/(30) | S-4 |
| 108 (Comparison) | Em-108 | ExS-1/ExS-3/ExS-2 | S-4 |
| 109 (Comparison) | Em-109 | ExS-1/ExS-3/ExS-2 | S-14 |
| 110 (Invention) | Em-110 | (20)/(27)/(30) | S-4 |
| 111 (Comparison) | Em-111 | ExS-1/ExS-3/ExS-2 | S-4 |
| 112 (Comparison) | Em-112 | EXS-1/ExS-3/ExS-2 | S-19 |
| 113 (Invention) | Em-113 | (20)/(27)/(30) | S-4 |
| 114 (Invention) | Em-114 | (21)/(27)/(30) | S-4 |
| 115 (Invention) | Em-115 | (20)/(25)/(30) | S-4 |
| 116 (Comparison) | Em-116 | (20)/(27)/(30) | — |
| 117 (Comparison) | Em-117 | ExS-1/ExS-3/ExS-2 | — |
| 118 (Comparison) | Em-118 | (20)/(27)/(30) | — |
| 119 (Comparison) | Em-119 | ExS-1/EXS-3/ExS-2 | — |
| 120 (Invention) | Em-120 | (20)/(27)/(30) | S-4 |
| 121 (Invention) | Em-121 | (20)/(27)/(30) | S-4 |
| 122 (Invention) | Em-122 | (20)/(27)/(30) | S-4 |

| Sample No. | Compound of general formula (III) | Presence or absence of reducing agent | Sensitivity of red-sensitive layer | Change in cyan fogging from before to after the storage |
|---|---|---|---|---|
| 101 (Comparison) | H-4 | Present | 100 | 0.56 |
| 102 (Comparison) | — | Present | 100 | 0.66 |
| 103 (Invention) | — | Present | 110 | 0.20 |
| 104 (Inve.ntion) | — | Present | 115 | 0.15 |
| 105 (Invention) | — | Present | 115 | 0.13 |
| 106 (Invention) | — | Present | 115 | 0.42 |
| 107 (Invention) | — | Present | 120 | 0.09 |
| 108 (Comparison) | — | Present | 100 | 0.50 |
| 109 (Comparison) | — | Present | 100 | 0.50 |
| 110 (Invention) | — | Absent | 105 | 0.09 |
| 111 (Comparison) | — | Absent | 95 | 0.35 |
| 112 (Comparison) | — | Absent | 95 | 0.40 |
| 113 (Invention) | H-4 | Present | 120 | 0.07 |
| 114 (Invention) | — | Present | 115 | 0.12 |
| 115 (Invention) | — | Present | 115 | 0.12 |
| 116 (Comparison) | — | Absent | 93 | 0.38 |
| 117 (Comparison) | — | Absent | 95 | 0.40 |
| 118 (Comparison) | — | Present | 105 | 0.38 |
| 119 (Comparison) | — | Present | 105 | 0.75 |
| 120 (Invention) | H-2 | Present | 118 | 0.07 |
| 121 (Invention) | H-3 | Present | 116 | 0.07 |
| 122 (Invention) | H-9 | Present | 116 | 0.06 |

As can be seen from the results shown in Table 3, the light-sensitive materials of the present invention using sensitizing dyes represented by formula (II) and compounds represented by formula (I) had a high sensitivity and a low storage fog. It is particularly amazing that the increase of the sensitivity was large and the deterioration of the storage fog was small when reduction sensitization was performed.

Example 2

The compound (S-4) of the present invention was added to the 13th layer of the samples 116 to 119 of Example 1, and the resultant samples were similarly evaluated. Consequently, a remarkable storage fog improving effect was found in the samples 116 and 118.

Example 3

1) Support

A support used in this example was formed by the following method.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130°

C., and thermally fixed at 250° C. for 6 sec. The result was a 90-μm thick PEN film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the support were subjected to corona discharge, UV discharge, and glow discharge. Thereafter, one surface was coated with an undercoat solution (14 ml/m$^2$, by using a bar coater) consisting of 0.1 g/m$^2$ of gelatin, 0.03 g/m$^2$ of salicylic acid, 1 mg/m$^2$ of silica gel (average grain size 0.02 μm), and 0.04 g/m$^2$ of a polyamido-epichlorohydrin polycondensation product, forming an undercoat layer on the side at a high temperature during orientation. Drying was performed at 115° C. for 4 min.

3) Coating of Back Layers

The undercoated surface of the support was coated with an antistatic layer, a magnetic recording layer, and a slip layer having the following compositions as back layers.

3-1) Coating of Antistatic Layer 0.3 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, 0.02 g/m$^2$ of gelatin, 8 mg/m$^2$ of polyglycerol. polyglycidylether, and 5 mg/m$^2$ of polyoxyethylenesorbitan. monolaurylester were coated.

3-2) Coating of Magnetic Recording Layer 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-polyoxyethylene-propyloxytrimethoxysilane (polymerization degree 15, 15 wt %) was coated by a bar coater together with 1.2 g/m$^2$ of diacetylcellulose (iron oxide was dispersed by an open kneader and a sand mill) by using 0.1 g/m$^2$ of polymethylenepolyphenylisocyanate as a hardener and acetone, methylethylketone, and cyclohexane as solvents, thereby forming a 1.2-μm thick magnetic recording layer. 20 mg/m$^2$ of aluminum oxide (1.0 μm) were added as a polishing agent. Drying was performed at 115° C. for 4 min. The color density.increase of $D^B$ of the magnetic recording layer measured by an X-light (blue filter) was about 0.1. Also, the saturation magnetization moment, coercive force, and squareness ratio of the magnetic recording layer were 4.2 emu/g, 7.6×10$^4$ A/m, and 65%, respectively.

3-3) Preparation of Slip Layer

Hydroxypropylcellulose (2 mg/m$^2$), $C_6H_{13}CH(OH)C_{10}H_{20}COOC_{40}H_{81}$ (7.5 mg/m$^2$), $C_{16}H_{33}O(CH_2CH_2O)_{50}H$ (7.5 mg/m$^2$), poly(dimethylsiloxane) (1.5 mg/m$^2$), and sodium N-propylperfluorooctylsulfonamido. polyoxyethylenesulfonate (1.5 mg/m$^2$) were coated. Note that this mixture was melted in xylene/cyclohexanone (10/1) at 105° C. and dispersed in cyclohexanone (tenfold amount) at room temperature. Thereafter the mixture was formed into a dispersion (average grain size 0.05 μm) by using an ultrasonic dispersion apparatus before being added. Drying was performed at 97° C. for 3 min (all rollers and conveyors in the drying zone were at 97° C.). The resultant slip layer was found to have excellent characteristics; i.e., the coefficient of kinetic friction was 0.08 (5 mmø stainless steel hard sphere, load 100 g, speed 6 cm/min), the coefficient of static friction was 0.17 (clip method), and the coefficient of kinetic friction between an emulsion surface (to be described later) and the slip layer was 0.16.

4) Coating of Light-Sensitive Layers

The side away from the back layers obtained as above was coated with a plurality of layers having exactly the same compositions as in Example 1, thereby forming samples 201 to 222.

The light-sensitive material formed as above was cut into 24-mm wide, 160-cm long samples, and two square perforations of 2 mm side were formed at an interval of 5.8 mm in portions 0.7 mm away from one side in the widthwise direction along the longitudinal direction of the light-sensitive material. Two such sets were formed at an interval of 32 mm and packed in a plastic film cartridge explained in FIGS. 1 to 7 of U.S. Pat. No. 5,296,887.

These samples were evaluated following the same procedures as in Example 1. The result was that each sample of the present invention had a high sensitivity and a small change of the storage fog.

As has been described above, the present invention can provide a silver halide photographic light-sensitive material with a high sensitivity and a low storage fog.

We claim:

1. A silver halide color photographic light-sensitive material comprising at least one red-sensitive silver halide emulsion layer, at least one green-sensitive emulsion layer, and at least one blue-sensitive emulsion layer on a support, wherein a light-sensitive silver halide emulsion in one or more of said emulsion layers contains a compound represented by formula (I) below and a compound represented by formula (II) below:

Formula (I)

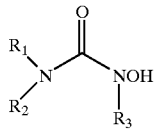

wherein $R_1$, $R_2$, and $R_3$ may be the same or different and each represents a hydrogen atom, an alkyl group, or an aryl group;

Formula (II)

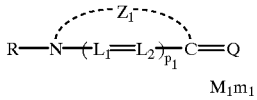

wherein R is an alkyl group represented as follows:

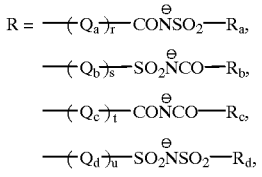

each of $R_a$, $R_b$, $R_c$, and $R_d$ represents an alkyl group, a heterocyclic group, an alkoxy group, an aryloxy group, or an amino group, each of $Q_a$, $Q_b$, $Q_c$, and $Q_d$ represents a methylene group, and each of r, s, t, and u represents an integer from 1 to 10, $L_1$ and $L_2$ represents a methine group, pi represents 0 or 1, $Z_1$ represents atoms required to form a 5- or 6-membered nitrogen-containing heterocyclic ring, $M_1$ represents a charge-balancing counter ion, $m_1$ represents a number from 0 to 10 required to neutralize electric charge of a molecule, and Q represents a methine group or a polymethine group substituted by a heterocyclic group or an aromatic group.

2. The material according to claim 1, further comprising at least one compound represented by formula (III) below:

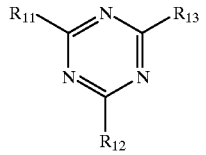

wherein, $R_{11}$, $R_{12}$, and $R_{13}$ may be the same or different and each represents a hydroxy group, an amino group, an alkylamino group, an arylamino group, an alkoxy group, an aryloxy group, an alkyl group, an aryl group, an alkylthio group, or a group represented by formula (IV) below, wherein at least one of $R_{11}$, $R_{12}$, and $R_{13}$ is a group represented by formula (IV) below:

Formula (IV)

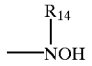

wherein, $R_{14}$ represents a hydrogen atom, an alkyl group, an alkenyl group, or an aryl group.

3. The material according to claim 1 or 2, wherein silver halide grains in said light-sensitive silver halide emulsion are reduction-sensitized.

4. The material according to claim 2, wherein the compound represented by formula (III) has the total carbon atoms of 3 to 15.

5. The material according to claim 4, wherein in the formula (III), each of $R_{11}$, $R_{12}$ and $R_{13}$ represents either one of an alkylamino group or the group represented by the formula (IV).

6. The material according to claim 5, wherein the total carbon atoms of the compound represented by formula (III) is 10 or less.

7. The material according to claim 6, wherein at least two of $R_{11}$, $R_{12}$ and $R_{13}$ of the formula (III) are the group represented by the formula (IV).

8. The silver halide photographic light-sensitive material of claim 2, wherein the compound of formula (III) is present in an amount of from $1.0\times10^{-5}$ mol to $5.0\times10^{-3}$ mol per mol of silver halide in the light-sensitive silver halide emulsion.

9. The material according to claim 1, wherein in the formula (I), $R_1$ represents a hydrogen atom, an alkyl group having the total carbon atoms of 1 to 10, or an aryl group having the total carbon atoms of 6 to 10; $R_2$ represents a hydrogen atom; and $R_3$ represents a hydrogen atom, an alkyl group having the total carbon atoms of 1 to 10, or an aryl group having the total carbon atoms of 6 to 10.

10. The material according to claim 9, wherein in the formula (I), $R_2$ represents a hydrogen atom; and the total carbon atoms of $R_1$ and $R_3$ is 7 or less.

11. The material according to claim 10, wherein in the formula (I), both $R_1$ and $R_2$ represent a hydrogen atom; and $R_3$ represents a hydrogen atom or an alkyl group having the total carbon atoms of 1 to 4.

12. The material according to claim 1, wherein the compound represented by the formula (II) is a compound represented by formula (II-1):

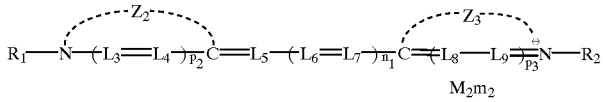

where each of $L_3$, $L_4$, $L_5$, $L_6$, $L_7$, $L_8$ and $L_9$ represents a methine group; each of $p_2$ and $p_3$ represents 0 or 1; $n_1$ represents 0, 1, 2 or 3; each of $Z_2$ and $Z_3$ represents at least one atom required to form a 5- or 6-membered nitrogen-containing heterocyclic ring; $M_2$ represents a charge-balancing counter ion; $m_2$ represents a number from 0 to 4 required to neutralize electric charge of a molecule; and each of $R_1$ and $R_2$ represents an alkyl group, provided that at least one of $R_1$ and $R_2$ is the alkyl group represented by R in the formula (II).

13. The material according to claim 12, wherein $n_1$ represents 1; and each of the rings formed with $Z_2$ and $Z_3$, respectively represents a benzoxazole nucleus or a benzothiazole nucleus.

14. The material according to claim 13, wherein in the formula (II-1), $R_1$ represents the alkyl group represented by R in the formula (II); and $R_2$ represents a sulfoalkyl group, a sulfoalkenyl group or a sulfoaralkyl group.

15. The material according to claim 1, wherein the compound represented by the formula (II) is a compound represented by formula (II-2):

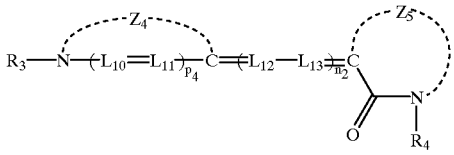

where each of $L_{10}$, $L_{11}$, $L_{12}$ and $L_{13}$ represents a methine group; $p_4$ represents 0 or 1; $n_2$ represents 0, 1, 2 or 3; each of $Z_4$ and $Z_5$ represents at least one atom required to form a 5- or 6-membered nitrogen-containing heterocyclic ring; $M_3$ represents a charge-balancing counter ion; $m_3$ represents a number form 0 to 4 required to neutralize electric charge of a molecule; $R_3$ represents the alkyl group represented by R in the formula (II); and $R_4$ represents an alkyl group, an aryl group or a heterocyclic group.

16. The material according to claim 1, wherein the compound represented by the formula (II) is a compound represented by formula (II-3):

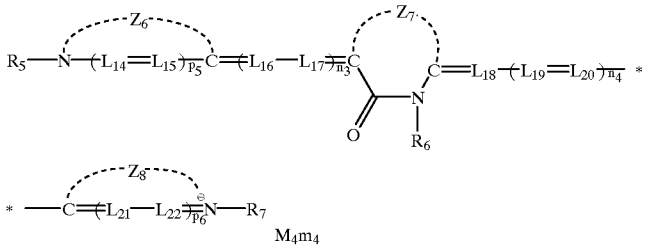

where each of $L_{14}$, $L_{15}$, $L_{16}$, $L_{17}$, $L_{18}$, $L_{19}$, $L_{20}$, $L_{21}$ and $L_{22}$ represents a methine group; each of $p_5$ and $p_6$ represents 0 or 1; each of $n_3$ and $n_4$ represents 0, 1, 2 or 3; each of $Z_6$, $Z_7$ and $Z_8$ represents at least one atom required to form a 5- or 6-membered nitrogen-containing heterocyclic ring; $M_4$ represents a charge-balancing counter ion, $m_4$ represents a number from 0 to 4 required to neutralize electric charge of a molecule; each of $R_5$ and $R_7$ represents an alkyl group, provided that at least one of $R_5$ and $R_7$ is the alkyl group represented by R in the formula (II); and $R_6$ represents an alkyl group, an aryl group or a heterocyclic group.

17. The silver halide photographic light-sensitive material of claim 1, wherein the compound of formula (I) is present in an amount of from $1.0\times10^{-5}$ mol to $5.0\times10^{-3}$ mol per mol of silver halide in the light-sensitive silver halide emulsion.

18. The silver halide photographic light-sensitive material of claim 1, wherein the compound of formula (II) is present in an amount of from $1.0\times10^{-5}$ mol to $5.0\times10^{-3}$ mol per mol of silver halide in the light-sensitive silver halide emulsion.

* * * * *